US008858045B2

(12) United States Patent
Harbers et al.

(10) Patent No.: US 8,858,045 B2
(45) Date of Patent: Oct. 14, 2014

(54) REFLECTOR ATTACHMENT TO AN LED-BASED ILLUMINATION MODULE

(71) Applicant: Xicato, Inc., San Jose, CA (US)

(72) Inventors: Gerard Harbers, Sunnyvale, CA (US); Christopher R. Reed, San Jose, CA (US); Peter K. Tseng, San Jose, CA (US); John S. Yriberri, San Jose, CA (US)

(73) Assignee: Xicato, Inc., San Jose, CA (US)

( * ) Notice: Subject to any disclaimer, the term of this patent is extended or adjusted under 35 U.S.C. 154(b) by 49 days.

(21) Appl. No.: 13/692,903

(22) Filed: Dec. 3, 2012

(65) Prior Publication Data

US 2013/0141918 A1 Jun. 6, 2013

Related U.S. Application Data

(60) Provisional application No. 61/566,996, filed on Dec. 5, 2011.

(51) Int. Cl.

| | |
|---|---|
| ***F21V 23/06*** | (2006.01) |
| ***F21V 7/00*** | (2006.01) |
| ***F21V 29/00*** | (2006.01) |
| ***F21V 17/10*** | (2006.01) |
| ***F21V 17/16*** | (2006.01) |
| ***F21V 7/20*** | (2006.01) |
| *F21V 17/14* | (2006.01) |
| *F21K 99/00* | (2010.01) |
| *F21V 7/09* | (2006.01) |
| *F21Y 105/00* | (2006.01) |
| *F21Y 101/02* | (2006.01) |
| *F21V 7/06* | (2006.01) |

(52) U.S. Cl.

CPC ..... *F21V 29/00* (2013.01); *F21V 17/14* (2013.01); *F21V 29/004* (2013.01); *F21V 17/105* (2013.01); *F21V 7/00* (2013.01); *F21K 9/54* (2013.01); *F21V 7/09* (2013.01); *F21Y 2105/001* (2013.01); *F21V 29/262* (2013.01); *F21V 17/164* (2013.01); *F21V 29/2293* (2013.01); *F21Y 2101/02* (2013.01); *F21V 7/06* (2013.01); *F21V 23/06* (2013.01); *F21V 7/20* (2013.01)

USPC ..... 362/433; 362/249.02; 362/296.01; 362/434

(58) Field of Classification Search

USPC ..... 362/433–436, 247, 249.02, 296.01, 362/311.02, 545

See application file for complete search history.

(56) References Cited

U.S. PATENT DOCUMENTS 1,049,533 A * 1/1913 Risinger ..... 362/434
1,266,818 A * 5/1918 Kirschbaum ..... 362/434

(Continued)

FOREIGN PATENT DOCUMENTS

DE 20 2006 002 583 U1 6/2007
DE 10 2007 03878 A1 2/2009

(Continued)

OTHER PUBLICATIONS

Invitation to Pay Additional Fees mailed on Apr. 5, 2013 for International Application No. PCT/US2012/067797 filed on Dec. 4, 2012 , 7 pages.

(Continued)

*Primary Examiner* — Laura Tso

(74) *Attorney, Agent, or Firm* — Silicon Valley Patent Group LLP

(57) ABSTRACT

An LED based illumination module includes a thermal interface surface that is coupled to a thermal interface surface of a reflector using engaging members that generate a compressive force between the thermal interface surfaces. The engaging members may be, e.g., protrusions that interface with recesses, spring pins, formed sheet metal, magnets, mounting collar, etc. The reflector may include a vented portion that is not optically coupled to the LED based illumination module to allow air to pass through the reflector.

16 Claims, 21 Drawing Sheets

(56) References Cited

U.S. PATENT DOCUMENTS

| | | | | |
|---|---|---|---|---|
| 1,374,735 | A * | 4/1921 | Harvey | 362/434 |
| 1,427,344 | A * | 8/1922 | Barclay | 362/434 |
| 4,829,408 | A | 5/1989 | Haydu | |
| 4,851,976 | A | 7/1989 | McMahan et al. | |
| 4,999,750 | A | 3/1991 | Gammache | |
| 5,315,490 | A | 5/1994 | Bastable | |
| 5,959,316 | A | 9/1999 | Lowery | |
| 6,351,069 | B1 | 2/2002 | Lowery et al. | |
| 6,504,301 | B1 | 1/2003 | Lowery | |
| 6,586,882 | B1 | 7/2003 | Harbers | |
| 6,600,175 | B1 | 7/2003 | Baretz et al. | |
| 6,634,616 | B2 | 10/2003 | Belknap | |
| 6,680,569 | B2 | 1/2004 | Mueller-Mach et al. | |
| 6,812,500 | B2 | 11/2004 | Reeh et al. | |
| 7,126,162 | B2 | 10/2006 | Reeh et al. | |
| 7,250,715 | B2 | 7/2007 | Mueller et al. | |
| 7,275,846 | B2 | 10/2007 | Browne et al. | |
| 7,405,944 | B2 | 7/2008 | Mayer et al. | |
| 7,479,662 | B2 | 1/2009 | Soules et al. | |
| 7,540,761 | B2 | 6/2009 | Weber et al. | |
| 7,564,180 | B2 | 7/2009 | Brandes | |
| 7,614,759 | B2 | 11/2009 | Negley | |
| 7,629,621 | B2 | 12/2009 | Reeh et al. | |
| 7,740,380 | B2 | 6/2010 | Thrailkill | |
| 7,866,845 | B2 | 1/2011 | Man | |
| 7,988,336 | B1 | 8/2011 | Harbers et al. | |
| 8,292,482 | B2 | 10/2012 | Harbers et al. | |
| 8,348,478 | B2 | 1/2013 | Pelton et al. | |
| 8,500,299 | B2 | 8/2013 | Speidel et al. | |
| 2004/0212991 | A1 | 10/2004 | Galli | |
| 2005/0276053 | A1 | 12/2005 | Nortrup et al. | |
| 2006/0221620 | A1 | 10/2006 | Thomas | |
| 2007/0081336 | A1 | 4/2007 | Bierhuizen et al. | |
| 2007/0109751 | A1 | 5/2007 | Mayer et al. | |
| 2007/0253202 | A1 | 11/2007 | Wu et al. | |
| 2007/0279921 | A1 | 12/2007 | Alexander et al. | |
| 2008/0130275 | A1 | 6/2008 | Higley et al. | |
| 2009/0213595 | A1 | 8/2009 | Alexander et al. | |
| 2011/0019409 | A1 | 1/2011 | Wronski | |
| 2011/0063837 | A1* | 3/2011 | Rizkin et al. | 362/235 |
| 2011/0140633 | A1 | 6/2011 | Archenhold | |
| 2011/0194285 | A1* | 8/2011 | Harbers et al. | 362/249.02 |
| 2011/0267822 | A1 | 11/2011 | Harbers et al. | |
| 2012/0038293 | A1* | 2/2012 | Guerrieri et al. | 315/313 |
| 2013/0044501 | A1 | 2/2013 | Rudisill et al. | |

FOREIGN PATENT DOCUMENTS

| | | | |
|---|---|---|---|
| DE | 20 2010 000 007 | U1 | 3/2010 |
| EP | 1 826 480 | A1 | 8/2007 |
| WO | WO 2004/071143 | A1 | 8/2004 |
| WO | WO 2010/044011 | A1 | 4/2010 |
| WO | WO 2011/025244 | A2 | 3/2011 |

OTHER PUBLICATIONS

Machine Translation in English of Abstract of DE 10 2007 038787 A1 visited at www.espacenet.com on May 28, 2013, 2 pages.

International Search Report mailed on Jul. 15, 2013 for International Application No. PCT/US2012/067797 filed on Dec. 4, 2012, 15 pages.

* cited by examiner

REFLECTOR ATTACHMENT TO AN LED-BASED ILLUMINATION MODULE

CROSS REFERENCE TO RELATED APPLICATIONS

This application claims priority under 35 USC 119 to U.S. Provisional Application No. 61/566,996, filed Dec. 5, 2011 which is incorporated by reference herein in its entirety.

TECHNICAL FIELD

The described embodiments relate to illumination modules that include Light Emitting Diodes (LEDs).

BACKGROUND

The use of LEDs in general lighting is becoming more desirable. Illumination devices that include LEDs typically require large amounts of heat sinking and specific power requirements. Consequently, many such illumination devices must be mounted to light fixtures that include heat sinks and provide the necessary power. The typically connection of an illumination devices to a light fixture, unfortunately, is not user friendly. Consequently, improvements are desired.

SUMMARY

An LED based illumination module includes a thermal interface surface that is coupled to a thermal interface surface of a reflector using engaging members that generate a compressive force between the thermal interface surfaces. The engaging members may be, e.g., protrusions that interface with recesses, spring pins, formed sheet metal, magnets, mounting collar, etc. The reflector may include a vented portion that is not optically coupled to the LED based illumination module to allow air to pass through the reflector.

Further details and embodiments and techniques are described in the detailed description below. This summary does not define the invention. The invention is defined by the claims.

DETAILED DESCRIPTION

Reference will now be made in detail to background examples and some embodiments of the invention, examples of which are illustrated in the accompanying drawings.

Figure 1A:
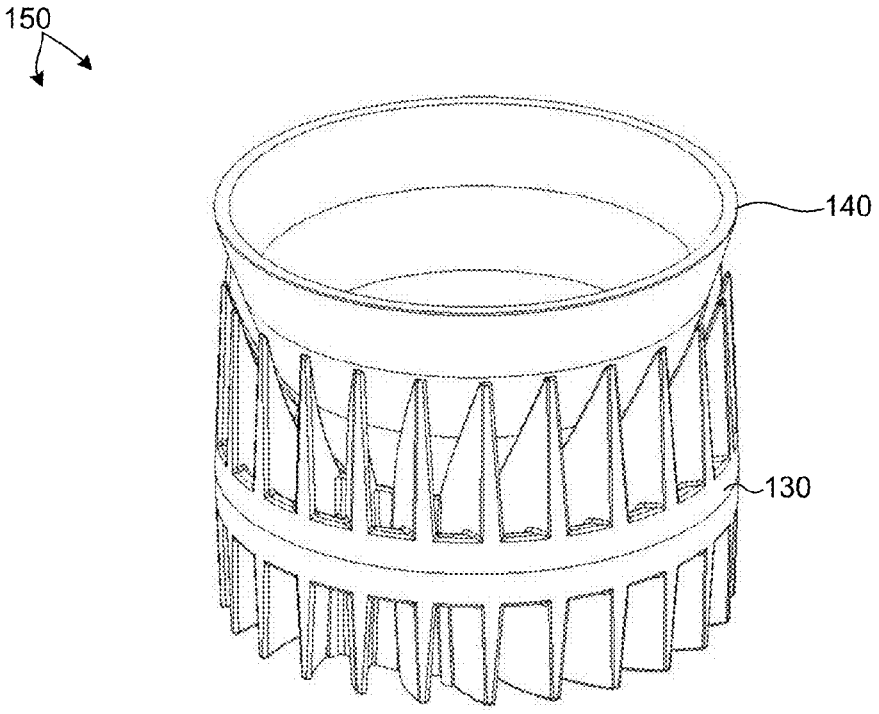
FIGS. 1A-1C illustrate a perspective view, a partial cut away view and another partial cut away view of an exemplary luminaire.
Figure 1B:
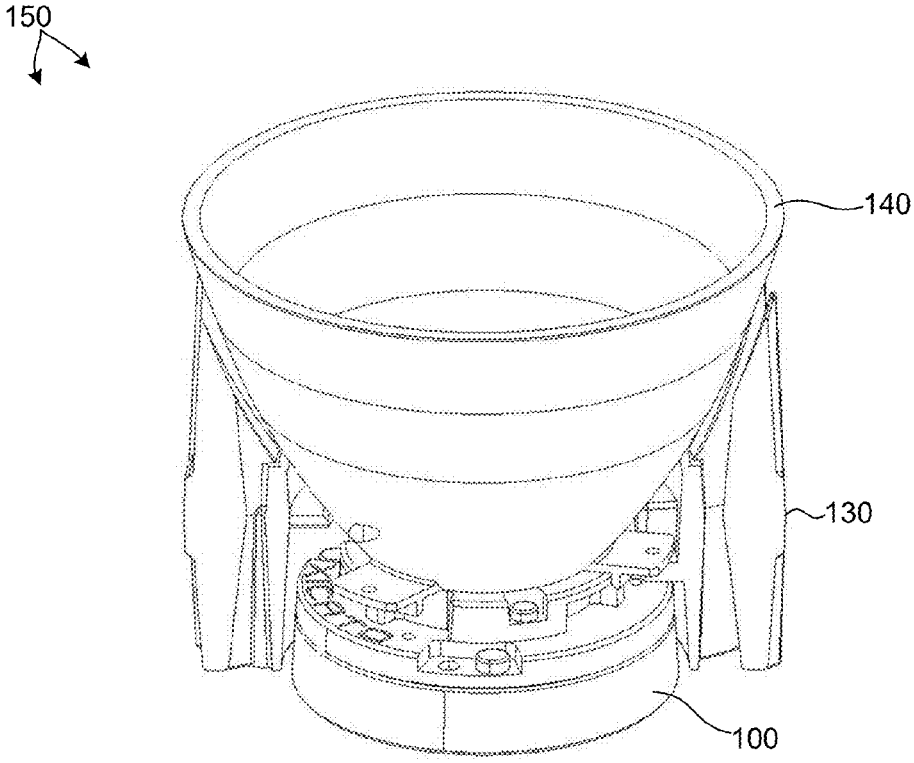
Figure 1C:
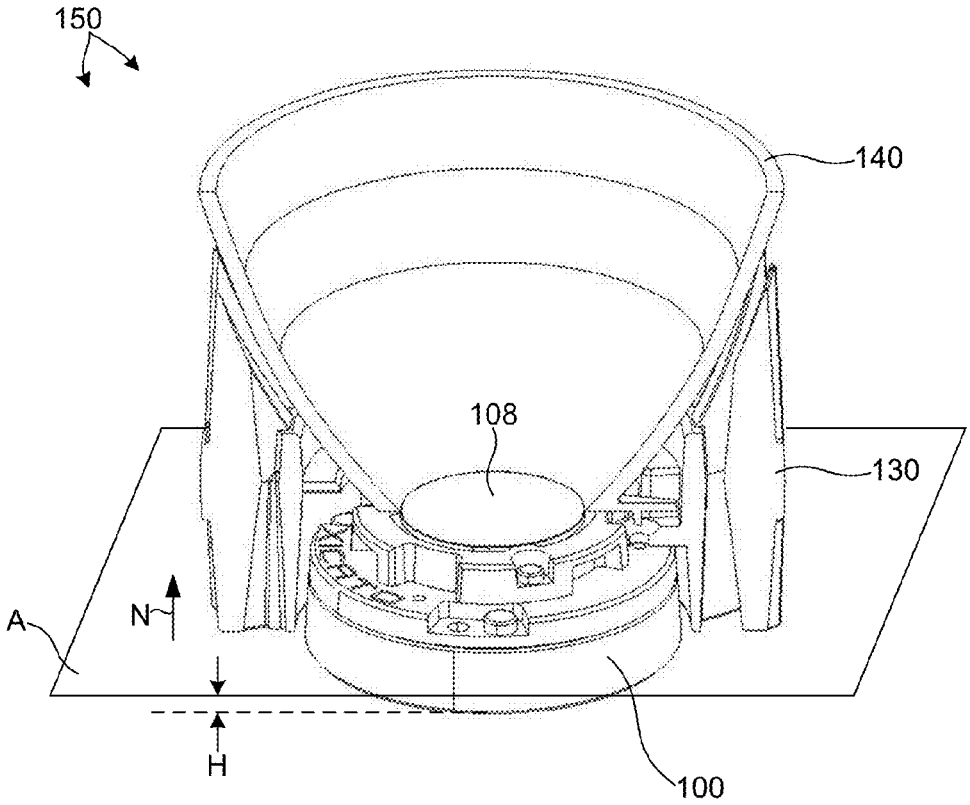

FIGS. 1A-1C illustrate an exemplary luminaire 150. The luminaire 150 illustrated in FIG. 1A includes an LED based illumination module 100 (shown in FIGS. 1B and 1C) and a top facing heat sink 130. Heat sink 130 may include other structural and decorative elements (not shown). For example, heat sink 130 may be part of a light fixture. In the embodiment depicted in FIGS. 1A-1C, luminaire 150 includes a reflector 140 mounted to top facing heat sink 130. Reflector 140 includes an interior surface or surfaces that shape light emitted from LED based illumination module 100. In some other embodiments, reflector 140 may be part of top facing heat sink 130. For example, heat sink 130 may include an interior surface or surfaces that shape light emitted from LED based illumination module 100. In some other embodiments, reflector 140 is mounted to LED based illumination module 100 directly.

Figure 2A:
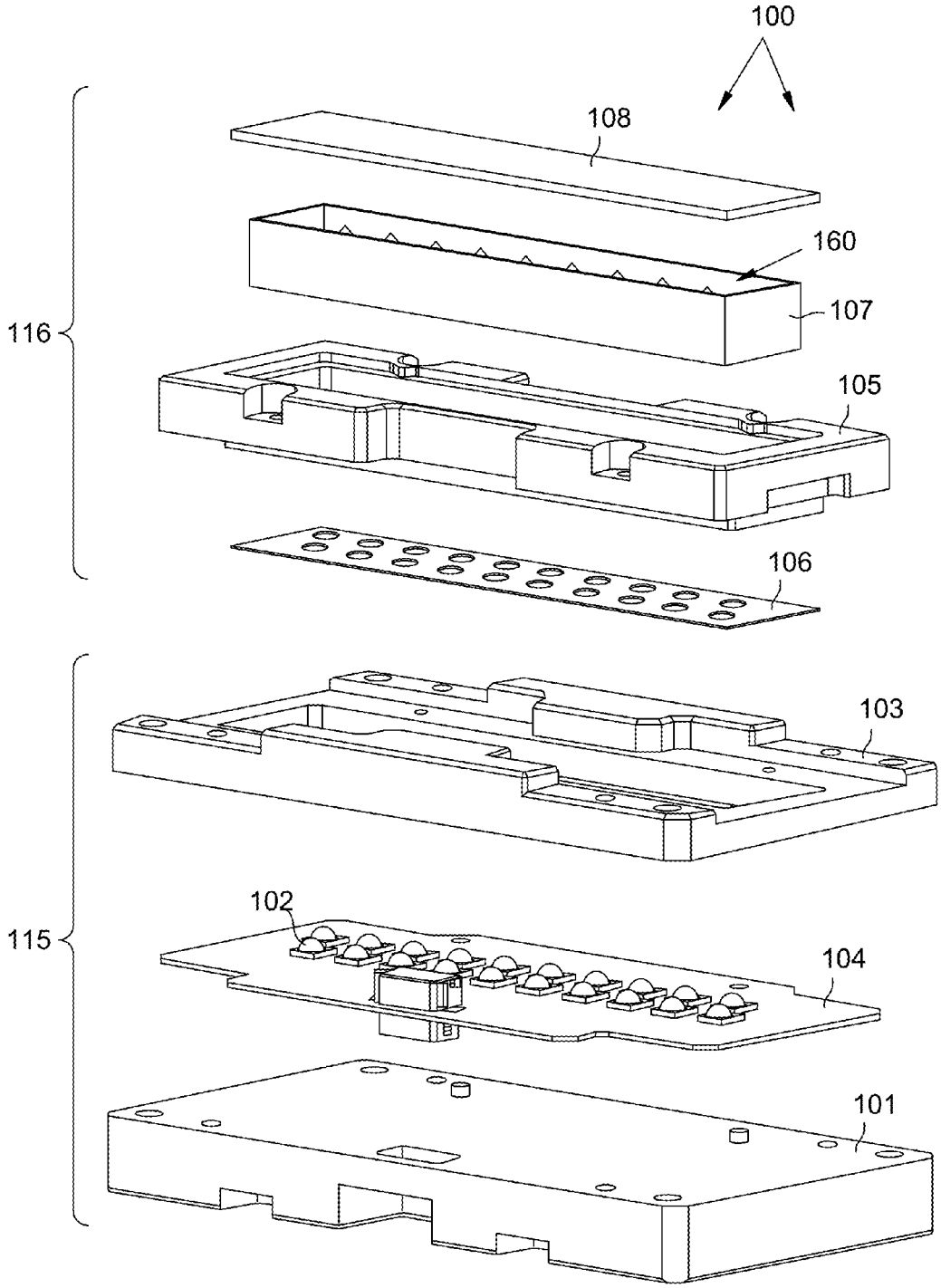
FIG. 2A shows an exploded view illustrating components of an exemplary LED based illumination module.
Figure 2B:
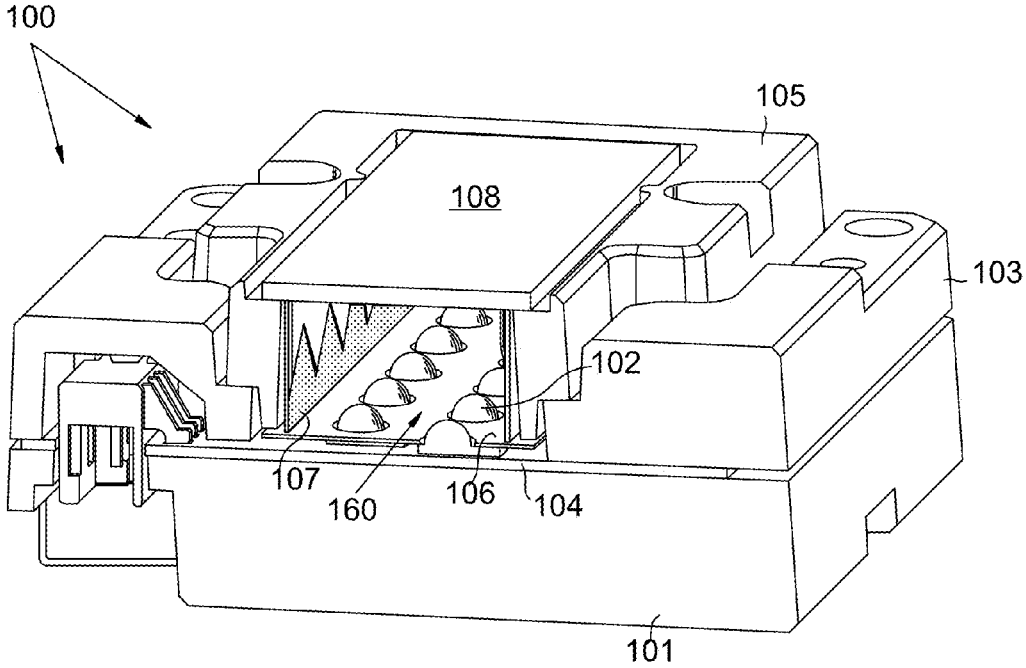
FIG. 2B illustrates a perspective, cross-sectional view of LED based illumination module as depicted in FIG. 2A.

As illustrated in FIG. 1A, luminaire 150 is circular in shape. This example is for illustrative purposes. Examples of illumination modules of general polygonal and curved shapes may also be contemplated. For example, an LED based illumination module 100 with a rectangular form factor is illustrated in FIGS. 2A-2B.

FIG. 1B illustrates a view of luminaire 150 with a portion of heat sink 130 cut away to expose LED based illumination module 100. FIG. 1C illustrates a view of luminaire 150 with a portion of both heat sink 130 and reflector 140 cut away to expose the output window 108 of LED based illumination module 100.

As illustrated in FIGS. 1A-1C, heat sink 130 is top facing. The entire body of heat sink 130 extends forward (in the direction of light output of luminaire 150) from LED based illumination module 100. As depicted in FIG. 1C a plane A is oriented parallel to output window 108 and is located a distance H above the bottom surface of LED based illumination module 100. In the depicted embodiment, the heat sink extends forward in a direction normal to plane A (indicated as surface normal N in FIG. 1C) from plane A. In some embodiments, the entire body of heat sink 130 is located on the top facing side of plane A and plane A may be located anywhere from the bottom surface of LED based illumination module 100 to the top of LED based illumination module 100. In this manner, luminaire 150 may be installed in applications where the total height of luminaire 150 is constrained. Heat sink 130 is generally made from a thermally conductive material, such as aluminum, copper, die cast metal, etc. and is thermally coupled to illumination module 100. Heat flows by conduction through illumination module 100 and heat sink 130. Heat also flows via thermal convection over heat sink 130.

In one aspect, top facing heat sink 130 is operable to dissipate a significant percentage of heat generated by LED based illumination module 100 to the environment and is removably coupled to illumination module 100, e.g., by means of threads, a clamp, a twist-lock mechanism, or other appropriate arrangement. In some embodiments, more than twenty five percent of heat generated by LED based illumination module 100 is dissipated to the environment through removable, top facing heat sink 130. In some other embodiments, more than fifty percent of heat generated by LED based illumination module 100 is dissipated to the environment through removable, top facing heat sink 130. In some other embodiments, more than seventy five percent of heat generated by LED based illumination module 100 is dissipated to the environment through removable, top facing heat sink 130. The different percentages of heat dissipation are made possible based on the configuration of the heat sink and whether another heat sink is located on the back side of the LED based illumination module 100, and if so, the configuration of that heat sink.

In some embodiments (e.g., the embodiment illustrated in FIGS. 1A-1C), reflector 140 is located within an envelope formed from top facing heat sink 130. Reflector 140 may be used to direct light emitted from illumination module 100. Reflector 140 may also be made from thermally conductive material and may be thermally coupled to any of illumination module 100 and top facing heat sink 130. In these embodiments, heat flows by conduction into thermally conductive reflector 140 and is dissipated into the environment. Heat also flows via thermal convection over the reflector 140. Optical elements, such as a diffuser or reflector 140 may be removably coupled to illumination module 100, e.g., by means of threads, a clamp, a twist-lock mechanism, or other appropriate arrangement.

Illumination module 100 includes at least one thermally conductive surface that is thermally coupled to top facing heat sink 130, e.g., directly or using thermal grease, thermal tape, thermal pads, or thermal epoxy. For adequate cooling of the LEDs, a thermal contact area of at least 50 square millimeters, but preferably 100 square millimeters should be used per one watt of electrical energy flow into the LEDs on the board. For example, in the case when 20 LEDs are used, a 1000 to 2000 square millimeter heat sink contact area should be used. Using a larger heat sink 130 permits the LEDs 102 to be driven at higher power, and also allows for different heat sink designs, so that the cooling capacity is less dependent on the orientation of the heat sink. In addition, fans or other solutions for forced cooling may be used to remove the head from the device.

FIG. 2A shows an exploded view illustrating components of an exemplary LED based illumination module 100. It should be understood that as defined herein an LED based illumination module is not an LED, but is an LED light source or fixture or component part of an LED light source or fixture. LED based illumination module 100 includes one or more LED die or packaged LEDs and a mounting board to which LED die or packaged LEDs are attached. FIG. 2B illustrates a perspective, cross-sectional view of LED based illumination module 100 as depicted in FIG. 2A.

LED based illumination module 100 includes one or more solid state light emitting elements, such as light emitting diodes (LEDs) 102, mounted on mounting board 104. Mounting board 104 may be attached to mounting base 101 and secured in position by mounting board retaining ring 103. Together, mounting board 104 populated by LEDs 102 and mounting board retaining ring 103 comprise light source sub-assembly 115. Light source sub-assembly 115 is operable to convert electrical energy into light using LEDs 102. The light emitted from light source sub-assembly 115 is directed to light conversion sub-assembly 116 for color mixing and color conversion. Light conversion sub-assembly 116 includes cavity body 105 and output window 108, and optionally includes either or both bottom reflector insert 106 and sidewall insert 107. Output window 108 is fixed to the top of cavity body 105. Cavity body 105 includes interior sidewalls which may be used to reflect light from the LEDs 102 until the light exits through output window 108 when sub-assembly 116 is mounted over light source sub-assembly 115. Bottom reflector insert 106 may optionally be placed over mounting board 104. Bottom reflector insert 106 includes holes such that the light emitting portion of each LED 102 is not blocked by bottom reflector insert 106. Sidewall insert 107 may optionally be placed inside cavity body 105 such that the interior surfaces of sidewall insert 107 reflect the light from the LEDs 102 until the light exits through the output window 108 when sub-assembly 116 is mounted over light source sub-assembly 115.

In this embodiment, the sidewall insert 107, output window 108, and bottom reflector insert 106 disposed on mounting board 104 define a light mixing cavity 160 in the LED based illumination module 100 in which a portion of light from the LEDs 102 is reflected until it exits through output window 108. Reflecting the light within the cavity 160 prior to exiting the output window 108 has the effect of mixing the light and providing a more uniform distribution of the light that is emitted from the LED based illumination module 100. Portions of sidewall insert 107 may be coated with a wavelength converting material. Furthermore, portions of output window 108 may be coated with a different wavelength converting material. The photo converting properties of these materials in combination with the mixing of light within cavity 160 results in a color converted light output by output window 108. By tuning the chemical properties of the wavelength converting materials and the geometric properties of the coatings on the interior surfaces of cavity 160, specific color properties of light output by output window 108 may be specified, e.g. color point, color temperature, and color rendering index (CRI).

Cavity 160 may be filled with a non-solid material, such as air or an inert gas, so that the LEDs 102 emit light into the non-solid material. By way of example, the cavity may be hermetically sealed and argon gas used to fill the cavity. Alternatively, nitrogen may be used. In other embodiments, cavity 160 may be filled with a solid encapsulant material. By way of example, silicone may be used to fill the cavity.

The LEDs 102 can emit different or the same colors, either by direct emission or by phosphor conversion, e.g., where phosphor layers are applied to the LEDs as part of the LED package. Thus, the illumination module 100 may use any combination of colored LEDs 102, such as red, green, blue, amber, or cyan, or the LEDs 102 may all produce the same color light or may all produce white light. For example, the LEDs 102 may all emit blue or UV light. When used in combination with phosphors (or other wavelength conversion means), which may be, e.g., in or on the output window 108, applied to the sidewalls of cavity body 105, or applied to other components placed inside the cavity (not shown), such that the output light of the illumination module 100 has the color as desired.

The mounting board 104 provides electrical connections to the attached LEDs 102 to a power supply (not shown). In one embodiment, the LEDs 102 are packaged LEDs, such as the Luxeon Rebel manufactured by Philips Lumileds Lighting. Other types of packaged LEDs may also be used, such as those manufactured by OSRAM (Ostar package), Luminus Devices (USA), Cree (USA), Nichia (Japan), or Tridonic (Austria). As defined herein, a packaged LED is an assembly of one or more LED die that contains electrical connections, such as wire bond connections or stud bumps, and possibly includes an optical element and thermal, mechanical, and electrical interfaces. The LEDs 102 may include a lens over the LED chips. Alternatively, LEDs without a lens may be used. LEDs without lenses may include protective layers, which may include phosphors. The phosphors can be applied as a dispersion in a binder, or applied as a separate plate. Each LED 102 includes at least one LED chip or die, which may be mounted on a submount. The LED chip typically has a size about 1 mm by 1 mm by 0.5 mm, but these dimensions may vary. In some embodiments, the LEDs 102 may include multiple chips. The multiple chips can emit light of similar or different colors, e.g., red, green, and blue. In addition, different phosphor layers may be applied on different chips on the same submount. The submount may be ceramic or other appropriate material. The submount typically includes electrical contact pads on a bottom surface that are coupled to contacts on the mounting board 104. Alternatively, electrical bond wires may be used to electrically connect the chips to a mounting board.

Along with electrical contact pads, the LEDs 102 may include thermal contact areas on the bottom surface of the submount through which heat generated by the LED chips can be extracted. The thermal contact areas are coupled to heat spreading layers on the mounting board 104. Heat spreading layers may be disposed on any of the top, bottom, or intermediate layers of mounting board 104. Heat spreading layers may be connected by vias that connect any of the top, bottom, and intermediate heat spreading layers.

In some embodiments, the mounting board 104 conducts heat generated by the LEDs 102 to the sides of the board 104 and the top of the board 104. In one example, the top of mounting board 104 may be thermally coupled to a top facing heat sink 130 (shown in FIGS. 1A-1C) via retaining ring 103. In other examples, mounting board 104 may be directly coupled to a heat sink, or a lighting fixture and/or other mechanisms to dissipate the heat, such as a fan. For example, mounting board retaining ring 103 and cavity body 105 may conduct heat away from the top surface of mounting board 104.

Mounting board 104 may be an FR4 board, e.g., that is 0.5 mm thick, with relatively thick copper layers, e.g., 30 μm to 100 μm, on the top and bottom surfaces that serve as thermal contact areas. In other examples, the board 104 may be a metal core printed circuit board (PCB) or a ceramic submount with appropriate electrical connections. Other types of boards may be used, such as those made of alumina (aluminum oxide in ceramic form), or aluminum nitride (also in ceramic form).

Mounting board 104 includes electrical pads to which the electrical pads on the LEDs 102 are connected. The electrical pads are electrically connected by a metal, e.g., copper, trace to a contact, to which a wire, bridge or other external electrical source is connected. In some embodiments, the electrical pads may be vias through the board 104 and the electrical connection is made on the opposite side, i.e., the bottom, of the board. Mounting board 104, as illustrated, is rectangular in dimension. LEDs 102 mounted to mounting board 104 may be arranged in different configurations on rectangular mounting board 104. In one example LEDs 102 are aligned in rows extending in the length dimension and in columns extending in the width dimension of mounting board 104. In another example, LEDs 102 are arranged in a hexagonally closely packed structure. In such an arrangement each LED is equidistant from each of its immediate neighbors. Such an arrangement is desirable to increase the uniformity of light emitted from the light source sub-assembly 115.

Figure 3:
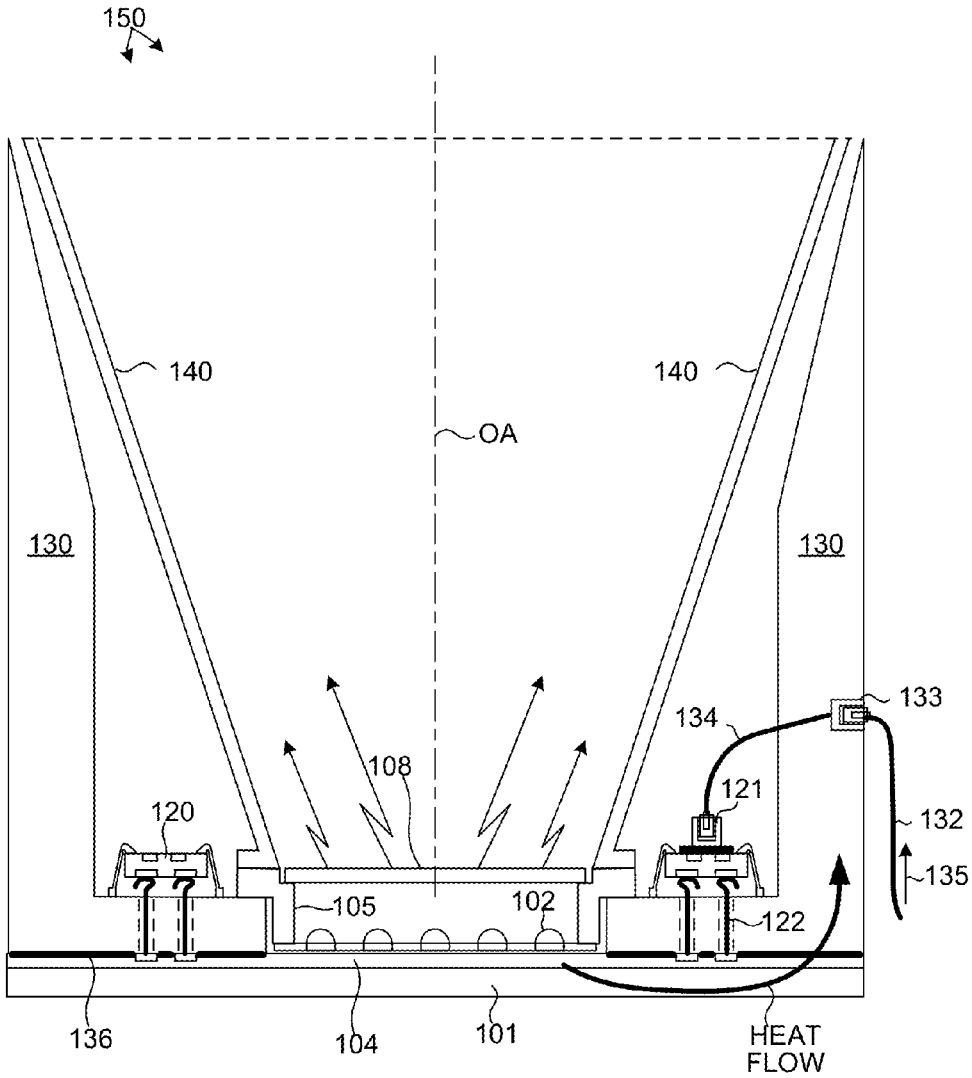
FIG. 3 illustrates a cut-away view of a luminaire in another embodiment.

FIG. 3 illustrates a cut-away view of luminaire 150 in another embodiment. Top facing heat sink 130 and reflector 140 are removably coupled to illumination module 100. For example, any of top facing heat sink 130 and reflector 140 may be coupled to module 100 by a twist-lock mechanism. In this manner any of top facing heat sink 130 and reflector 140 is aligned with module 100 and is coupled to module 100 by rotating any of top facing heat sink 130 and reflector 140 about an optical axis (OA) of luminaire 150. In the engaged position, an interface pressure is generated between mating thermal interface surfaces 136 of any of top facing heat sink 130 and reflector 140 and module 100. In this manner, heat generated by LEDs 102 may be conducted via mounting board 104 into any of top facing heat sink 130 and reflector 140.

In some embodiments, luminaire 150 includes an electrical interface module (EIM) 120 within an envelope formed by top facing heat sink 130. The EIM 120 communicates electrical signals to mounting board 104. In the embodiment depicted in FIG. 3, electrical conductors 132 are coupled to heat sink 130 at electrical connector 133. By way of example, electrical connector 133 may be a registered jack (RJ) connector commonly used in network communications applications. In other examples, electrical conductors 132 may be coupled to heat sink 130 by screws or clamps. In other examples, electrical conductors 132 may be coupled to heat sink 130 by a removable slip-fit electrical connector. Connector 133 is coupled to conductors 134. Conductors 134 are removably coupled to electrical connector 121 mounted to EIM 120. Similarly, electrical connector 121 may be a RJ connector or any suitable removable electrical connector. Electrical signals 135 are communicated over conductors 132 through electrical connector 133, over conductors 134, through electrical connector 121 to EIM 120. EIM 120 routes electrical signals 135 from electrical connector 121 to appropriate electrical contact pads on EIM 120. Electrical signals 135 may include power signals and data signals. In the illustrated example, spring pins 122 couple contact pads of EIM 120 to contact pads of mounting board 104. In this manner, electrical signals are communicated from EIM 120 to mounting board 104. Mounting board 104 includes conductors to appropriately couple LEDs 102 to the contact pads of mounting board 104. In this manner, electrical signals are communicated from mounting board 104 to appropriate LEDs 102 to generate light.

Figure 4:
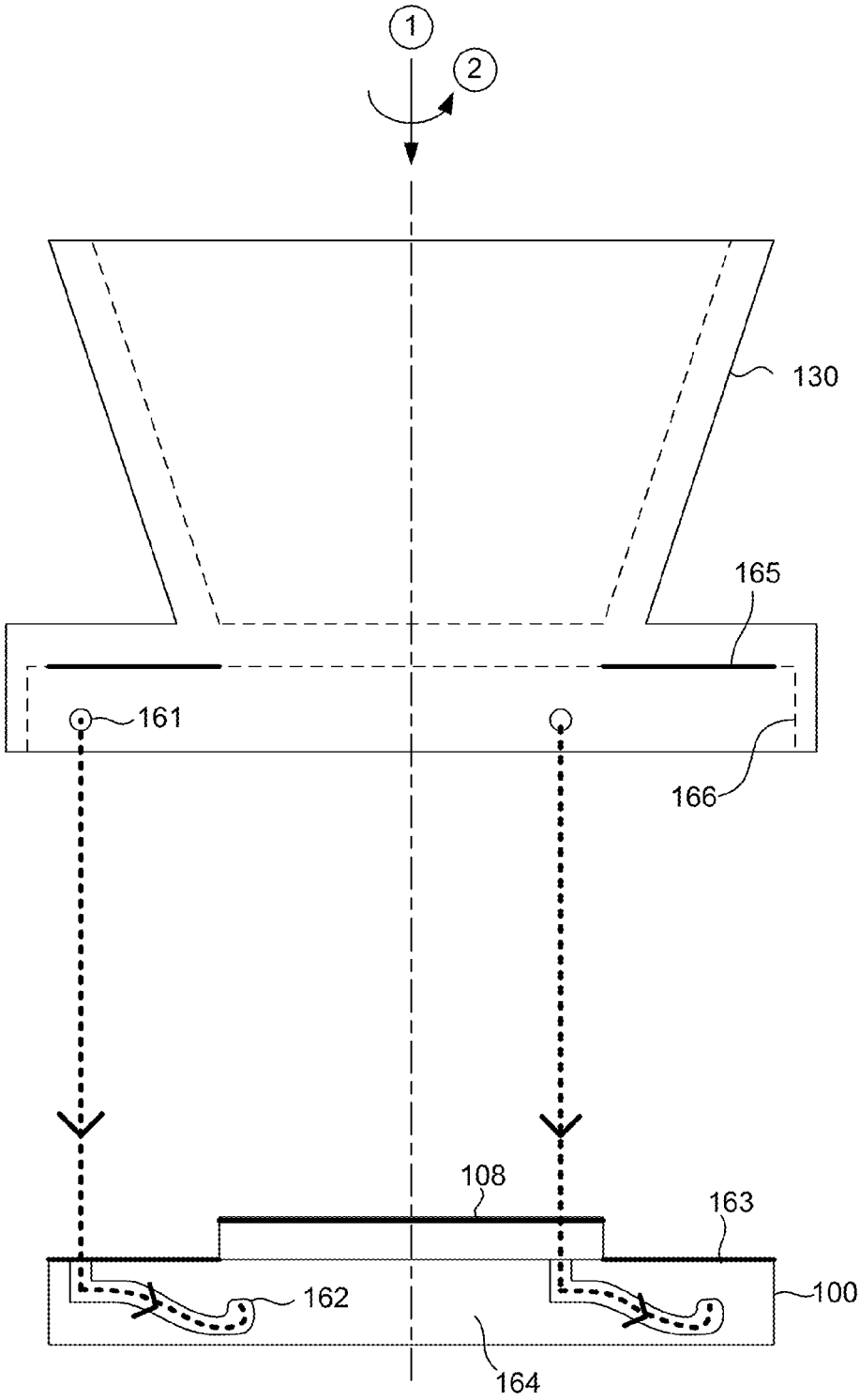
FIG. 4 illustrates a side view of a top facing heat sink and LED based illumination module.

FIG. 4 illustrates an embodiment suited for convenient removal and installation of a top facing heat sink 130 operable to dissipate heat generated by LED based illumination module 100. FIG. 4 illustrates a side view of a top facing heat sink 130 and LED based illumination module 100 configured such that they may be coupled together by aligning features of both the heat sink and the module and rotating the top facing heat sink 130 with respect to the module to complete the attachment. Top facing heat sink 130 includes elastic mounting members 161 positioned along an inwardly facing surface 166 of heat sink 130. LED based illumination module 100 includes heat sink engaging members 162 positioned on a heat sink (reflector) engaging surface 164 of LED based illumination module 100, which is oriented perpendicular (or approximately perpendicular) to the thermal interface surface 163. The heat sink engaging members 162 are configured to engage elastic mounting members 161 when heat sink 130 is brought into alignment with LED based illumination module 100. As top facing heat sink 130 is rotated with respect to LED based illumination module 100, thermal interface surface 165 of heat sink 130 is brought into contact with thermal interface surface 163 of LED based illumination module 100. As elastic mounting members 161 are fully engaged in corresponding heat sink engaging members 162, a compressive force is generated between LED based illumination module 100 and heat sink 130 across thermal interfaces 163 and 165. In this manner, heat generated by LED based illumination module 100 flows from module 100 to heat sink 130 and is dissipated by heat sink 130.

Figure 5:
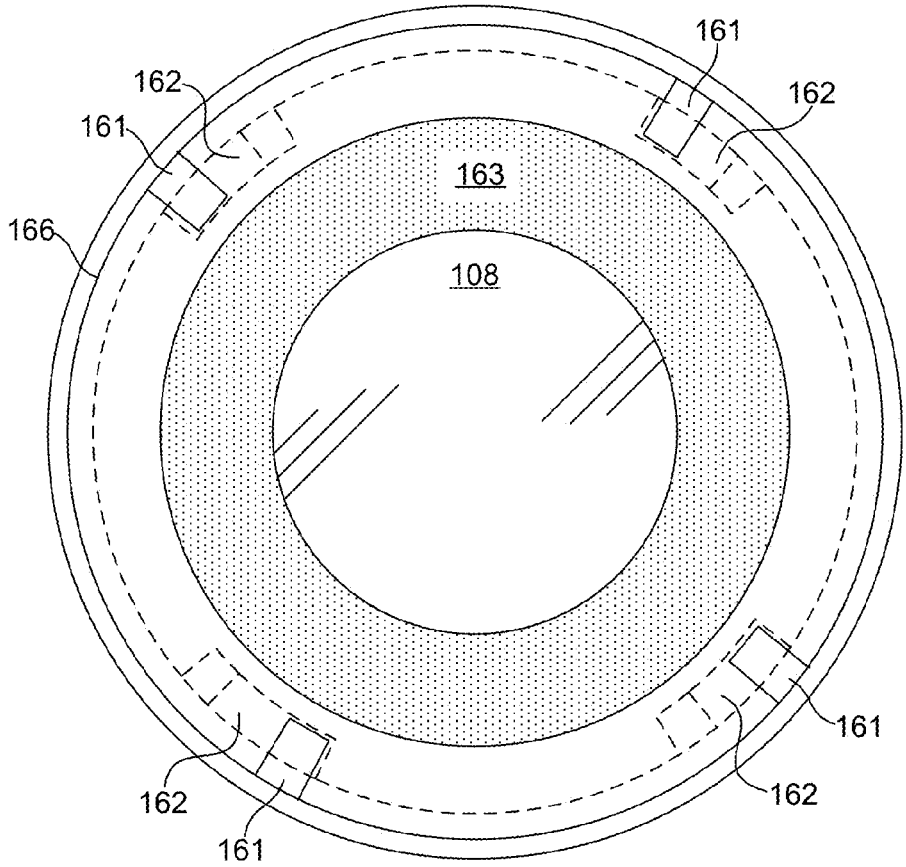
FIG. 5 illustrates a cutaway, top view of top facing heat sink affixed to LED based illumination module.

FIG. 5 illustrates a cutaway, top view of top facing heat sink 130 affixed to LED based illumination module 100. As depicted, elastic mounting members 161 are located on surface 166 that faces inward toward the center of LED based illumination module 100. In addition, elastic mounting members 161 are engaged with heat sink engaging members 162.

Figure 6:
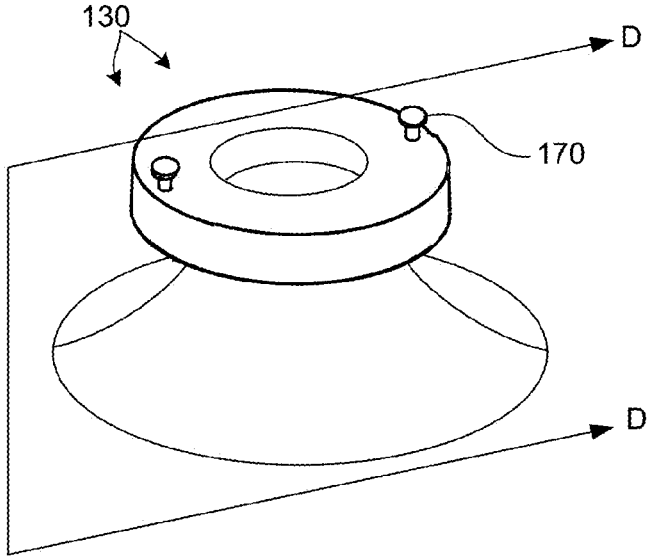
FIG. 6 illustrates a perspective view of the bottom side of heat sink.

FIGS. 6-11 illustrate an embodiment suited for convenient removal and installation of a top facing heat sink 130 to an LED based illumination module 100. FIG. 6 illustrates a perspective view of the bottom side of heat sink 130. In the depicted embodiment, heat sink 130 includes a reflector surface to direct light emitted from LED based illumination module 100. In the illustrated embodiment, heat sink 130 includes two elastic mounting members 170. In the depicted embodiment the elastic mounting members are spring pin assemblies 170 positioned opposite one another near the perimeter of heat sink 130. In another embodiment, additional spring pin assemblies may be employed and positioned equidistant from one another near the perimeter of module 100. In other embodiments, the spring pin assemblies may not be positioned equidistant from one another. This may be desirable to create a mechanism that allows only one orientation between heat sink 130 and LED based illumination module 100 when heat sink 130 is coupled to LED based illumination module 100.

Figure 7:
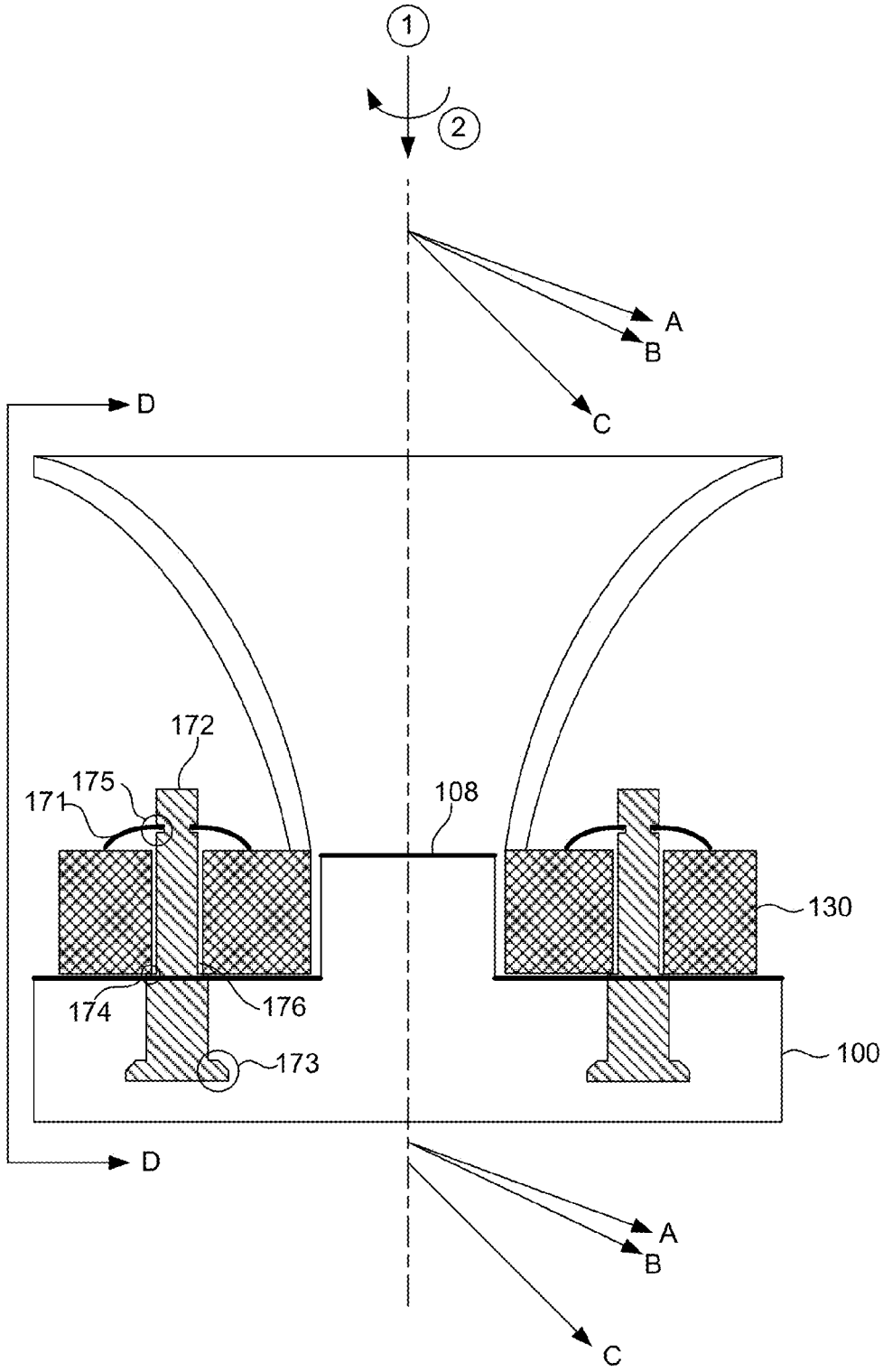
FIG. 7 illustrates cross-section D of FIG. 6.

FIG. 6 illustrates a perspective view of top facing heat sink 130 with spring pins 170 installed. A section indicator D is illustrated in FIG. 6. FIG. 7 illustrates cross-section D of FIG. 6. A spring pin assembly 170 includes a spring 171 and a pin 172. In the illustrated embodiment, pin 172 includes a tapered head 173, a shoulder 174, and a radial groove 175. In the illustrated embodiment, spring 171 is a cup shaped c-clip. In other embodiments, other spring mechanisms may be employed (e.g. coil spring and e-clip). Pin 172 loosely fits through a hole 176 provided in heat sink 130. The diameter of shoulder 174 is greater than the diameter of hole 176, thus pin 172 may only extend through heat sink 130 to the position where shoulder 174 contacts the bottom surface of heat sink 130. At this position, spring 171 is inserted into radial groove 175 of pin 172. In this manner, spring 171 acts to retain pin 172 within hole 176. Spring 171 also provides a restoring force acting in the direction of pin insertion into hole 176 in response to a displacement of pin 172 in a direction opposite the direction of pin insertion.

Figure 8:
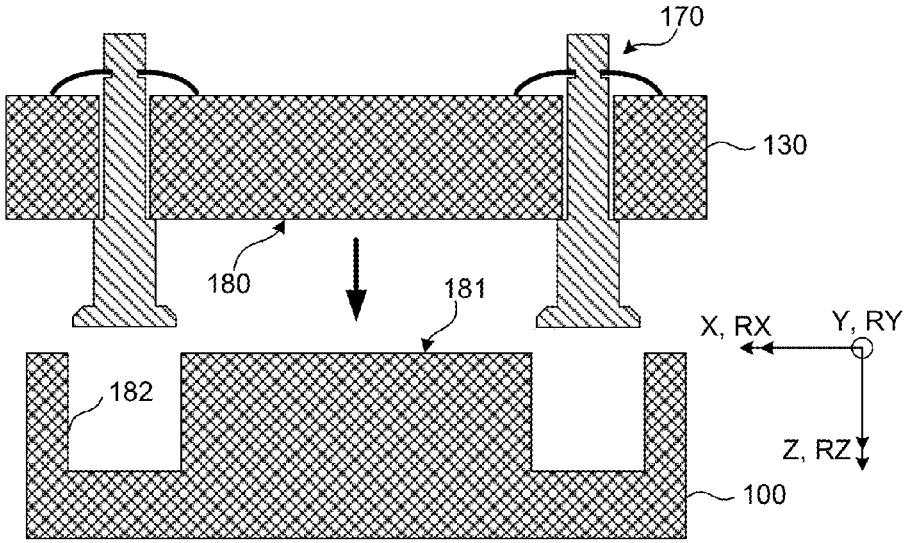
FIG. 8 illustrates the steps of aligning and replaceably coupling heat sink with LED based illumination module.

FIG. 8 illustrates the steps of aligning and replaceably coupling heat sink 130 with LED based illumination module 100 in accordance with the first embodiment. LED based illumination module 100 includes thermal interface surface 181 on the top face of LED based illumination module 100. Heat sink 130 includes thermal interface surface 180. LED based illumination module 100 includes heat sink engaging members 182. In the illustrated example, the heat sink engaging members are radially cut ramped shoulder grooves 182. Shoulder grooves 182 are positioned on the face of LED illumination module 100 to correspond with the position of spring pins 170.

In a first step, heat sink 130 is aligned with LED based illumination module 100. As illustrated in FIG. 8, spring pins 170 are aligned with shoulder grooves 182 in the horizontal dimensions x and y and in the rotational dimensions Rx, Ry, and Rz, then module 100 is translated in the z dimension until the interface surfaces 180 and 181 come into contact. After alignment, in a second step, heat sink 130 is rotated with respect to LED based illumination module 100 to couple heat sink 130 to LED based illumination module 100.

Figure 9A:
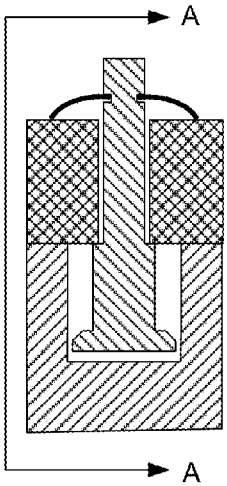
FIG. 9A illustrates section A of FIG. 7 and depicts the alignment of heat sink and LED based illumination module.
Figure 9B:
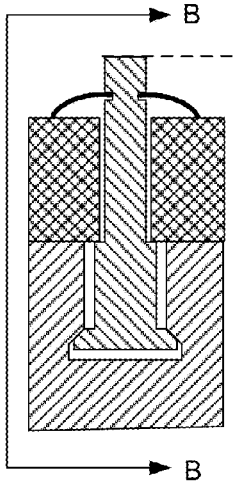
FIG. 9B illustrates section B of FIG. 7 and depicts the heat sink rotated with respect to section A and the start of engagement of the spring pin and the ramped shoulder groove.
Figure 9C:
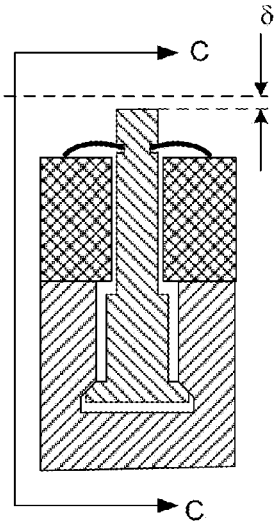
FIG. 9C illustrates section C of FIG. 7 and depicts the heat sink rotated to a fully engaged position where heat sink is coupled to LED based illumination module.

Three section indicators, A, B, and C, are illustrated in FIG. 7. Section A, illustrated in FIG. 9A, depicts the alignment of heat sink 130 and LED based illumination module 100. In the aligned position, spring pin 170 loosely sits within a blind hole portion of ramped shoulder groove 182. In this position, shoulder 174 of pin 172 remains in contact with the bottom surface of heat sink 130. Section B, illustrated in FIG. 9B, is a view of heat sink 130 rotated with respect to Section A and illustrates the start of engagement of the spring pin 170 and the ramped shoulder groove 182. In this position, spring pin 170 contacts a tapered portion of groove 182. As illustrated the tapered head of pin 170 makes contact with the corresponding taper of groove 182. Section C, illustrated in FIG. 9C, is a view of heat sink 130 rotated to a fully engaged position where heat sink 130 is coupled to LED based illumination module 100. In this position, spring pin 172 is displaced by an amount, Δ, in the z direction with respect to the bottom surface of heat sink 130. Shoulder 174 moves off of the bottom surface of heat sink 130. As a result of this displacement, spring 171 deforms and generates a restoring force in the direction opposite the displacement of pin 172. This restoring force acts to generate a compressive force between thermal interface surface 180 of heat sink 130 and thermal interface surface 181 of LED based illumination module 100. Groove 182 ramps downward from the face of LED based illumination module 100 as it is radially cut from the initial aligned position to the engaged position. As a result, pin 172 is displaced in the z-direction as heat sink 130 is rotated from the aligned position to the engaged position.

Figure 10A:
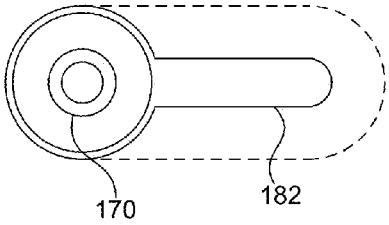
FIGS. 10A and 11A illustrate a top and side view of a spring pin aligned with shoulder groove along section A of FIG. 7.
Figure 10C:
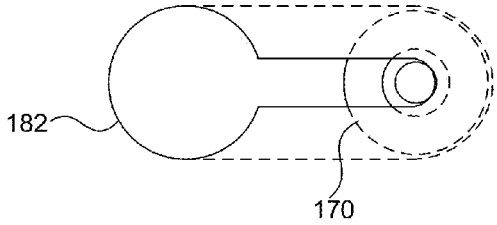
FIGS. 10C and 11 C illustrate a top and side view of spring pin engaged in shoulder groove along section C of FIG. 7.
Figure 10B:
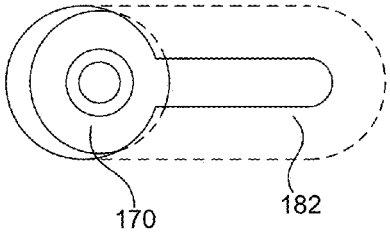
FIGS. 10B and 11B illustrate a top and side view of spring pin engaging shoulder groove along section B of FIG. 7.
Figure 11A:
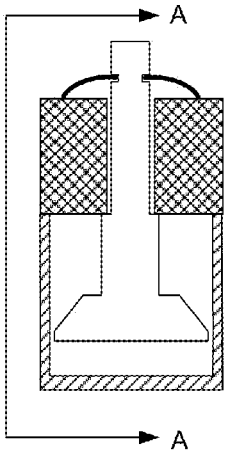
Figure 11B:
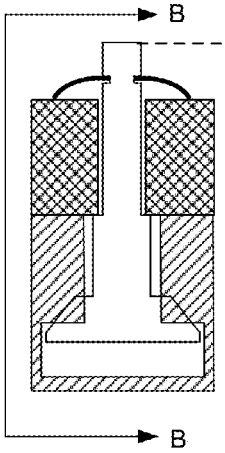
Figure 11C:
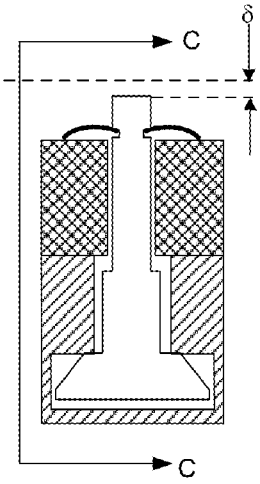

In another embodiment, LED based illumination module 100 includes radially cut shoulder grooves 182 that are not ramped. FIGS. 10-11 are illustrative of this embodiment. FIG. 10A illustrates a top view of spring pin 170 aligned with shoulder groove 182. Section A of FIG. 7 is illustrated in FIG. 11A. FIG. 11A depicts the alignment of heat sink 130 and LED based illumination module 100. In the aligned position, spring pin 170 loosely sits within a blind hole portion of shoulder groove 182. FIG. 10B illustrates a top view of spring pin 170 engaging shoulder groove 182. Section B of FIG. 7 is illustrated in FIG. 11B. In this view, heat sink 130 is rotated with respect to Section A and illustrates the start of engagement of the spring pin 170 and the shoulder groove 182. In this position, the tapered surface of spring pin 170 contacts shoulder groove 182. As illustrated the tapered head of pin 170 makes contact with groove 182. FIG. 10C illustrates a top view of spring pin 170 engaged in shoulder groove 182. Section C of FIG. 7 is illustrated in FIG. 11C. In this view heat sink 130 is rotated to a fully engaged position where heat sink 130 is coupled to LED based illumination module 100. In this position, spring pin 172 is displaced by an amount, Δ, in the z direction with respect to the bottom surface of heat sink 130. Shoulder 174 moves off of the bottom surface. As a result of this displacement, spring 171 deforms and generates a restoring force in the direction opposite the displacement of pin 172. This restoring force acts to generate a compressive force between thermal interface surface 180 of heat sink 130 and thermal interface surface 181 of LED based illumination module 100. Groove 182 remains at the same distance from the face of LED based illumination module 100 as it is radially cut from the initial aligned position to the engaged position. Pin 172 is displaced in the z-direction as module 100 is rotated from the aligned position to the engaged position by sliding between the tapered surface of pin 172 along shoulder groove 182.

Figure 12:
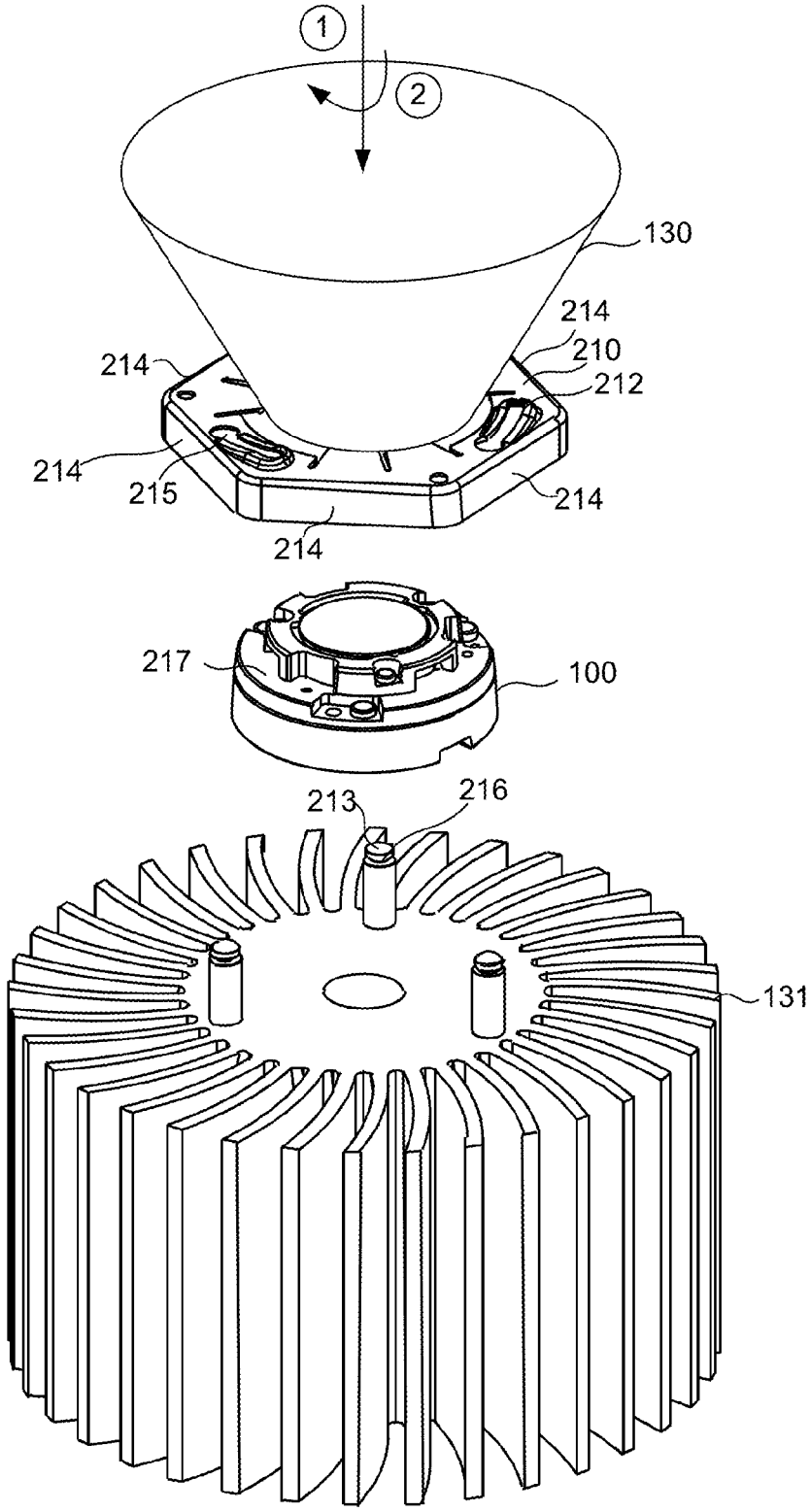
FIG. 12 illustrates a perspective view of bottom facing heat sink, LED based illumination module, and top facing heat sink including a mounting collar portion.

FIGS. 12-16 illustrate yet another embodiment suited for convenient removal and installation of a top facing heat sink 130 on an LED based illumination module 100. FIG. 12 illustrates a perspective view of bottom facing heat sink 131, LED based illumination module 100, and top facing heat sink 130 including a mounting collar assembly 210. Bottom facing heat sink 131 includes a plurality of pins 213. In the illustrated embodiment each pin 213 includes a groove 216 configured to engage with ramp feature 212 of top facing heat sink 130. In other embodiments pin 213 may include a head configured to engage with ramp feature 212. Each pin 213 is fixedly attached to bottom facing heat sink 131 (e.g. press fit, threaded, fixed by adhesive). Alternatively each pin 213 may be cast or machined as part of bottom facing heat sink 131. Pins 213 are arranged outside the perimeter of illumination module 100 such that module 100 may be placed between pins 213 such that the bottom surface of module 100 comes into contact with the top surface of bottom facing heat sink 131. Alternatively in some embodiments, some or all of pins 213 may be arranged within or along the perimeter of illumination module 100. In these embodiments, module 100 includes through holes such that pins 213 may pass through the holes until the bottom surface of module 100 comes into contact with the top surface of bottom facing heat sink 131. As illustrated, pins 213 are arranged equidistant from one another and are spaced such that illumination module 100 fits loosely between the pins. In other embodiments, pins 213 may not be arranged equidistant from one another. In these configurations, the lack of symmetry of the elements may be used as an indexing feature to align module 100 in a particular orientation with respect to bottom facing heat sink 131.

As depicted in FIG. 12, top facing heat sink 130 includes a reflector surface to direct light emitted from LED based illumination module 100. Top facing heat sink 130 includes elastic mounting members 211. In the illustrated embodiment, elastic mounting members 211 are included as an integral part of at least a portion of heat sink 130. For example, heat sink 130 may be a formed sheet metal part including elastic mounting members 211 as part of the single formed sheet metal part. In other examples, elastic mounting members 211 may be cast or molded as part of a single part heat sink 130. Top facing heat sink 130 may optionally include tool feature 214. As illustrated tool feature 214 includes a plurality of surfaces of heat sink 130. In the illustrated embodiment a complementary tool (e.g. wrench) may be employed to engage with the tool feature 214 of heat sink 130 to facilitate assembly and increase the torque that may be applied to heat sink 130.

As depicted in FIG. 12, heat sink 130 includes ramp features 212. In the illustrated example, ramp features 212 are formed into heat sink 130 (e.g. by stamping, molding, or casting). In other embodiments, ramp features 212 may be affixed to heat sink 130 (e.g. by soldering, welding, or adhesives).

In a first step, module 100 is captured between top facing heat sink 130 and bottom facing heat sink 131. As illustrated, module 100 is placed within pins 213 and heat sink 130 is placed over module 100. Heat sink 130 includes through holes 215 at the beginning of each ramp feature 212. In the aligned configuration, heat sink 130 is placed over module 100 such that pins 213 pass through the through holes 215 of heat sink 130.

In a second step, heat sink 130 is rotated with respect to bottom facing heat sink 131 to a fully engaged position. As discussed above, heat sink 130 may be rotated directly by human hands, or alternatively with the assistance of a tool acting on tool feature 214 to increase the torque applied to heat sink 130. As heat sink 130 is rotated, the grooves 216 of pins 213 engage with ramp feature 212 and elastic mounting members 211 engage with surface 217 of module 100. Surface 217 is illustrated for exemplary purposes, however, any surface of module 100 may used to engage with elastic mounting members 211. Once engaged, the rotation of heat sink 130 causes heat sink 130 to displace toward bottom facing heat sink 131. Furthermore, as a result of the displacement, elastic mounting members 211 deform and generate a compressive force between module 100 and heat sinks 130 and 131.

Figure 13A:
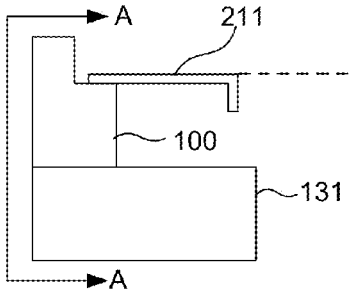
FIG. 13A illustrates elastic mounting members in the aligned position.
Figure 13B:
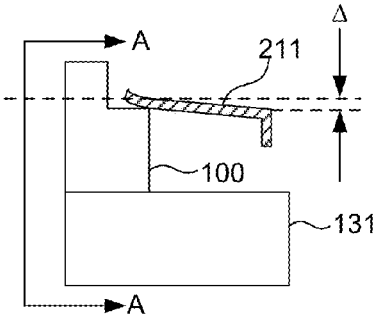
FIG. 13B illustrates elastic mounting members in the fully engaged position after rotation of heat sink with respect to heat sink.

FIG. 13A illustrates elastic mounting members 211 in the aligned position. In the aligned position, elastic mounting members 211 are in contact module 100, but are not deformed. FIG. 13B illustrates elastic mounting members 211 in the fully engaged position after rotation of heat sink 130 with respect to heat sink 131. In the fully engaged position, elastic mounting members 211 are in contact module 100 and are deformed. As discussed above, the deformation generates a compressive force acting to capture LED based illumination module 100 between heat sinks 130 and 131.

Figure 14A:
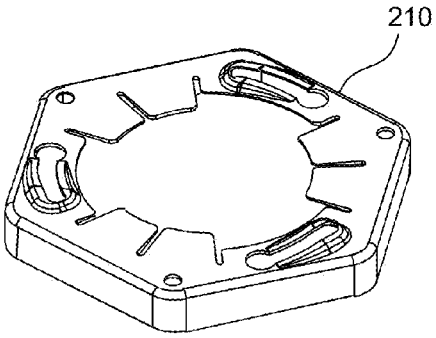
FIG. 14A illustrates a top, perspective view of a portion of heat sink with ramp feature.
Figure 14B:
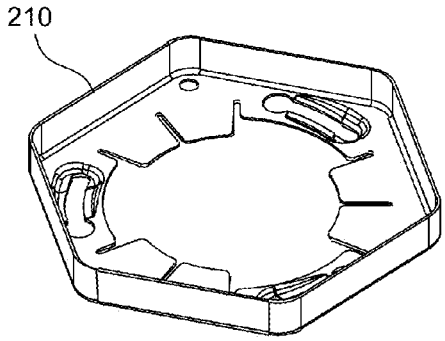
FIG. 14B illustrates a bottom, perspective view of heat sink with ramp feature.

FIG. 14A illustrates a top, perspective view of a portion of heat sink 130 with ramp feature 212. FIG. 14B illustrates a bottom, perspective view of heat sink 130 with ramp feature 212.

Figure 15A:
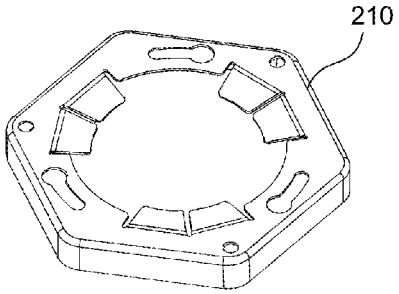
FIG. 15A illustrates a top, perspective view of a portion of heat sink
Figure 15B:
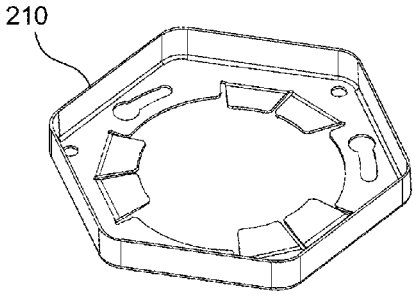
FIG. 15B illustrates a bottom, perspective view of a portion of heat sink.

FIG. 15A illustrates a top, perspective view of a portion of heat sink 130 and FIG. 15B illustrates a bottom, perspective view of a portion of heat sink 130. As discussed above, ramp feature 212 is optional. In some embodiments, feature 212 is not a ramp feature, but is simply a slot feature. The slot feature includes the cut-out portion of feature 212, but remains in plane with the top surface of reflector 140, rather than rising above the top surface as ramp feature 212 is depicted. In these embodiments, in a first step, heat sink 130 is placed over module 100 such that pins 213 pass through holes 215 of reflector 140 as discussed above. However, after elastic mounting members 211 come into contact with module 100, a force is applied to heat sink 130 in a direction normal to the bottom surface of module 100 that causes elastic mounting members 211 to deform and generate a force to press module 100 and heat sink 130 together. In these embodiments, an aligned position is reached when the grooves 216 of pins 213 align in the normal direction with ramp feature 212. In a second step, reflector 140 is rotated with respect to heat sink 130 to a locked position. In these embodiments, grooves 216 slide within ramp feature 212 and act to lock reflector 140 to heat sink 130.

Figure 16A:
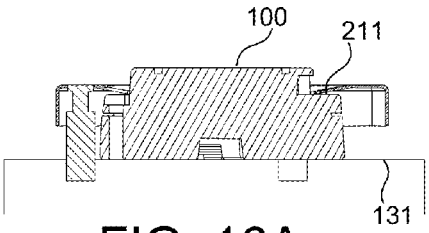
FIG. 16A illustrates a cross sectional view of a portion of heat sink, LED based illumination module, and bottom facing heat sink in the aligned position with elastic elements in contact, but not deformed.
Figure 16B:
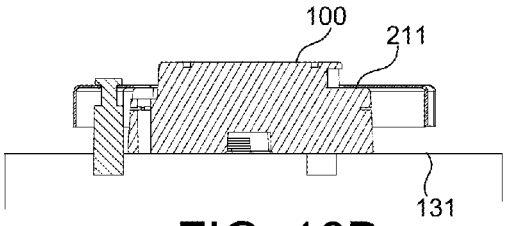
FIG. 16B illustrates a cross sectional view of a portion of heat sink, LED based illumination module, and bottom facing heat sink in the fully engaged position after rotation of the heat sink.

FIG. 16A illustrates a cross sectional view of a portion of heat sink 130, LED based illumination module 100, and heat sink 131. In the aligned position, elastic mounting members 211 are in contact module 100, but are not deformed. FIG. 16B illustrates the portion of the heat sink 130, module 100, and heat sink 131 in the fully engaged position after rotation of heat sink 130 with respect to heat sink 131. In the fully engaged position, elastic mounting members 211 are in contact with module 100 and are deformed. As discussed above, the deformation generates a force acting to capture module 100 between heat sink 130 and heat sink 131.

FIGS. 17-21 illustrate yet another embodiment suited for convenient removal and installation of a top facing heat sink 130 from an LED based illumination module 100.

Figure 17:
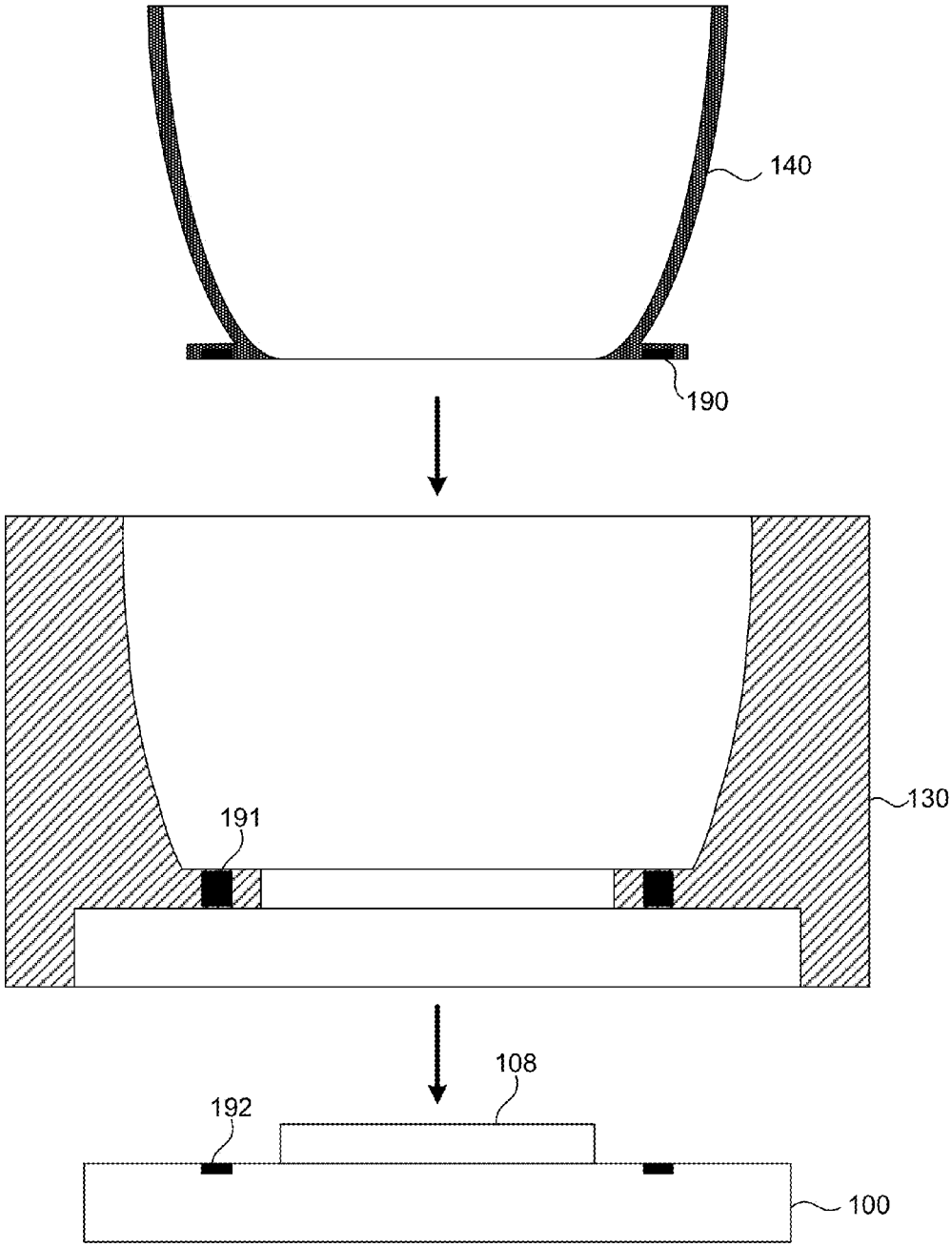
FIG. 17 depicts an embodiment that includes a reflector, a top facing heat sink, and an LED based illumination module coupled together with a magnet.

FIG. 17 depicts an embodiment that includes a reflector 140, a top facing heat sink 130, and an LED based illumination module 100 coupled together with a magnet 191. As depicted in FIG. 17, top facing heat sink 130 includes a magnet 191 at the interfaces with reflector 140 and LED based illumination module 100. In the depicted embodiment, reflector 140 includes an amount of magnetically conductive material 190 (e.g., ferrous metal) at the interface between reflector 140 and top facing heat sink 130 to facilitate a magnetic attraction force between reflector 140 and top facing heat sink 130. Similarly, LED based illumination module 100 includes an amount of magnetically conductive material 192 (e.g., ferrous metal) at the interface between LED based illumination module 100 and top facing heat sink 130 to facilitate a magnetic attraction force between LED based illumination module 100 and top facing heat sink 130.

In some other embodiments, any of reflector 140 and LED based illumination module 100 may be constructed from magnetically conductive material. In these embodiments, magnetic materials 190 and 192 may not be required to attach reflector 140 and LED based illumination module 100 to top facing heat sink 130 with magnet 191. However, magnetically conductive materials often do not exhibit optimal thermal conduction properties and it may be preferable to include a magnetically conductive material 190 that is different than the material used to construct reflector 140 to promote heat dissipation through reflector 140. Similarly, it may be preferable to include a magnetically conductive material 192 that is different than the material used to construct LED based illumination module 100 to promote heat dissipation through LED based illumination module 100.

Figure 19:
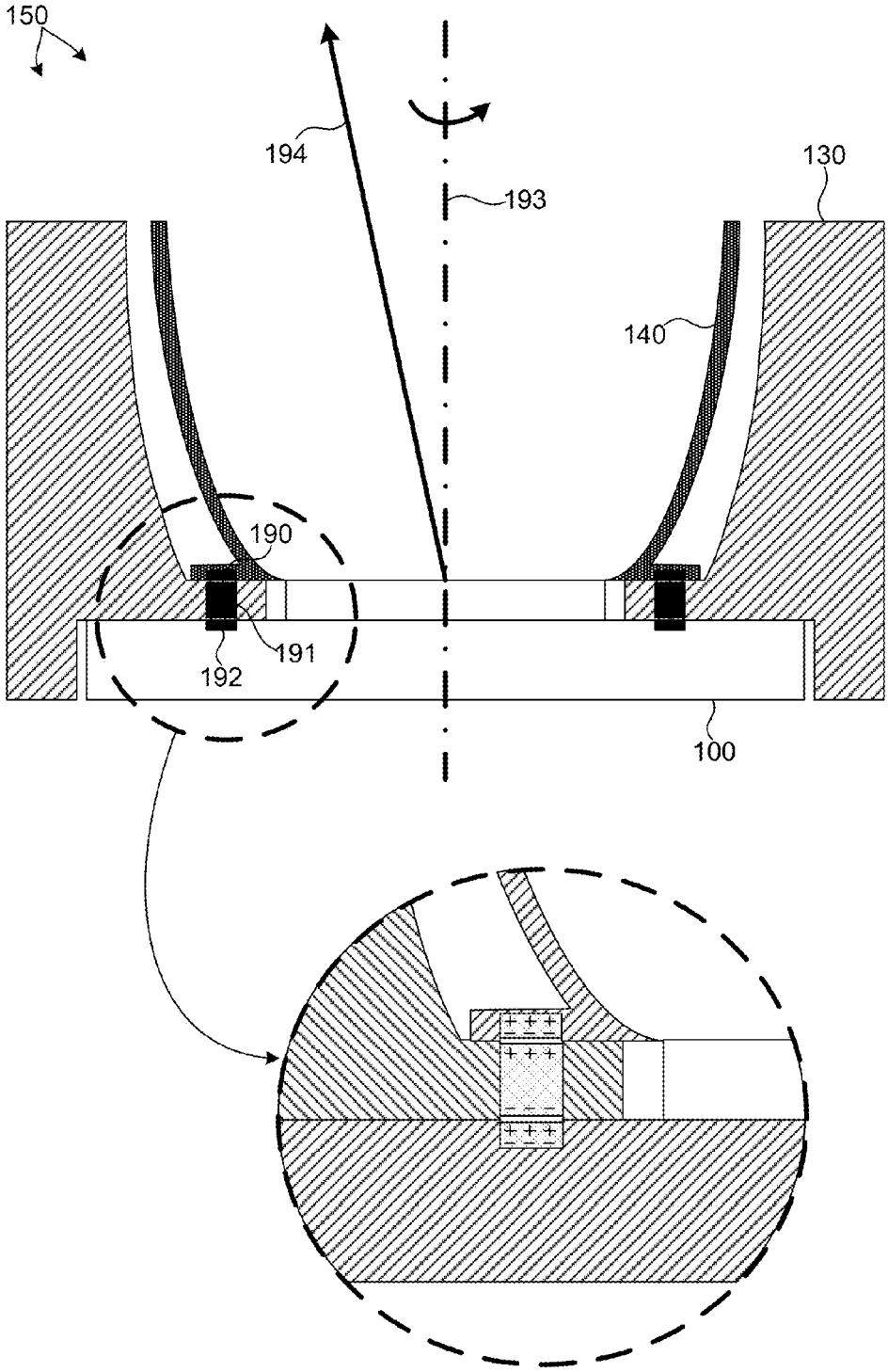
FIG. 19 is illustrative of another embodiment of a heat sink and reflector coupled to LED based illumination module by a magnet.

As depicted in FIG. 17, reflector 140 is stacked on heat sink 130 that is stacked on LED based illumination module 100. However, other configurations may be contemplated. In some embodiments, reflector 140 may be attached to LED based illumination module 100 directly with a magnet and heat sink 130 may also be directly attached to LED based illumination module 100 with the same magnet or a different magnet. In some other embodiments, heat sink 130 includes a reflector surface that directs light emitted from LED based illumination module and reflector 140 may be omitted. In some other embodiments, materials 190, 191, and 192 may all be magnetic materials. Their polarity may be arranged such that when reflector 140, heat sink 130, and LED based illumination module 100 are placed in close physical proximity to one another, a magnetic force is generated between material 191 and 190 that couples reflector 140 and heat sink 130 together and a magnetic force is generated between material 191 and 192 that couples heat sink 130 to LED based illumination module 100 together. FIG. 19 offers an example of a polarity structure to realize this arrangement.

Figure 18:
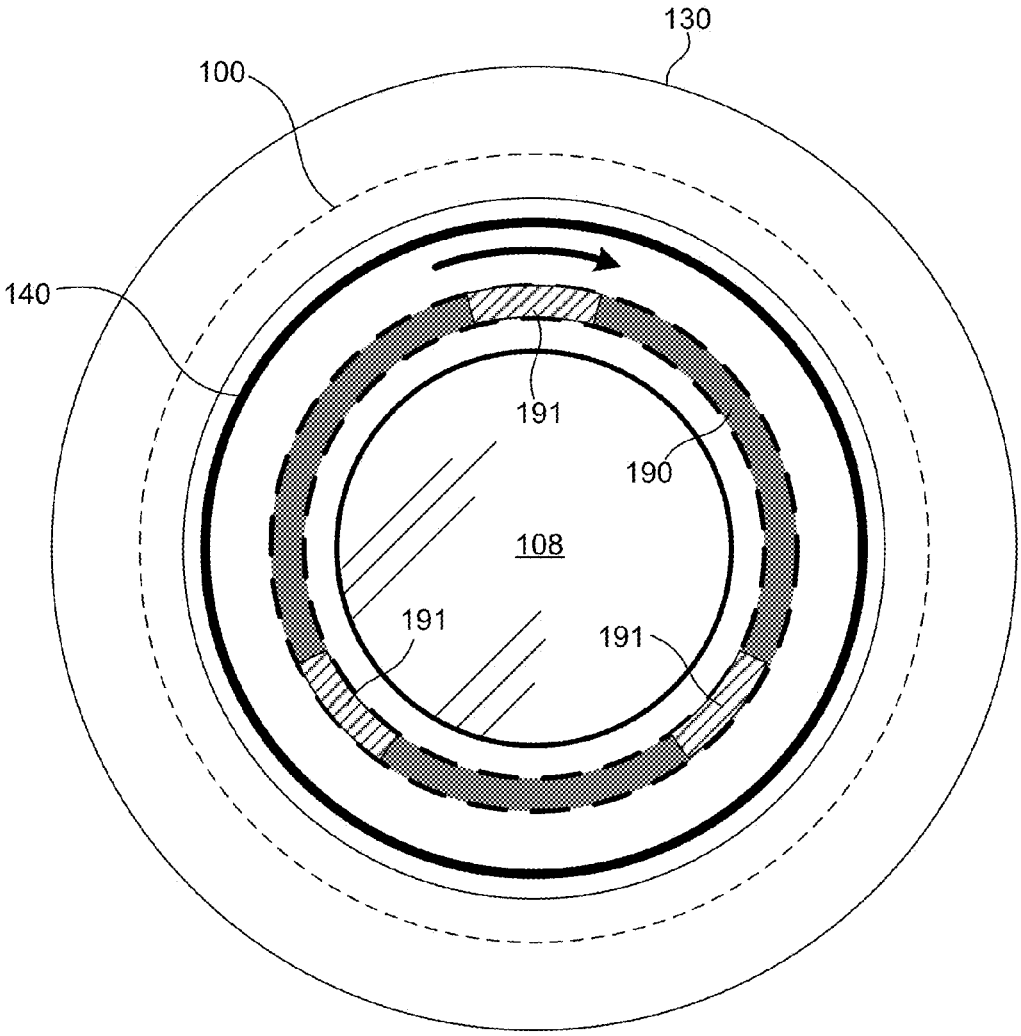
FIG. 18 illustrates a top view of the heat sink and reflector coupled to LED based illumination module as depicted in FIG. 17.

FIG. 18 illustrates a top view of heat sink 130 and reflector 140 coupled to LED based illumination module 100 as depicted in FIG. 17. As depicted reflector 140 includes magnetically conductive material 190 configured in a ring arrangement. Similarly, LED based illumination module 100 includes magnetically conductive material 192 (not shown) configured in a ring arrangement. Magnets 191 are arranged in three equal length segments spaced evenly apart along a ring that matches up with the rings of magnetically conductive material 190 and 192. In the depicted embodiment, heat sink 130 and reflector 140 can be independently rotated about a central axis of luminaire 150 as indicated by the arrow in FIG. 18. In some other embodiments a mechanical feature may be included to constrain the relative positions of heat sink 130 and reflector 140 with respect to LED based illumination module 100. This may be desirable in embodiments where any of heat sink 130 and reflector 140 are not axisymmetric.

FIG. 19 is illustrative of another embodiment of heat sink 130 and reflector 140 coupled to LED based illumination module 100 by a magnet. In the depicted embodiment, luminaire 150 includes a central axis 193. Central axis 193 is located in the geometric center of output window 108 and is oriented normal to output window 108 of LED based illumination module 100. In the depicted embodiment, reflector 140 includes an optical axis 194 that is not aligned with central axis 193. This may occur, for example, in embodiments where asymmetric reflectors are employed to generate off-axis illumination patterns from luminaires. As described with respect to FIG. 18, reflector 140 can be independently rotated about central axis 193 and coupled to LED based illumination module 100 in any orientation. As such, the orientation of reflector 140 (and optical axis 194) with respect to luminaire 150 is infinitely adjustable. An asymmetric reflector 140 may be constructed by commonly available injection molding techniques. Some geometries may require more complex mold designs (e.g., multiple actions) or in some cases, a reflector may have to be molded in two parts that are subsequently joined (e.g., by ultrasonic welding, adhesive, etc.). In some examples, magnet material 190 may be incorporated into reflector 140 by an insert molding technique. Although other techniques may be contemplated.

FIG. 19 also illustrates an arrangement of magnet materials 190, 191, and 192 with their respective polarities aligned such that reflector 140, heat sink 130, and LED based illumination module 100 are coupled together by attractive magnetic forces. Magnet materials 190, 191, and 192 may be arranged in this manner for desirable relative orientations of reflector 140, heat sink 130, and LED based illumination module 100. In addition, magnet materials 190, 191, and 192 may be arranged such that their respective polarities result in repulsive magnetic forces that repel any of reflector 140, heat sink 130, and LED based illumination module 100 from one another. In this manner, undesirable relative orientations of reflector 140, heat sink 130, and LED based illumination module 100 may be avoided by preventing attachment in undesirable orientations. This may be achieved, for example by breaking magnet materials 190, 191, and 192 into segments with opposite polarities such that only certain relative orientations of heat sink 130, reflector 140, and LED based illumination module 100 result in the generation of attractive forces among these elements.

Figure 20A:
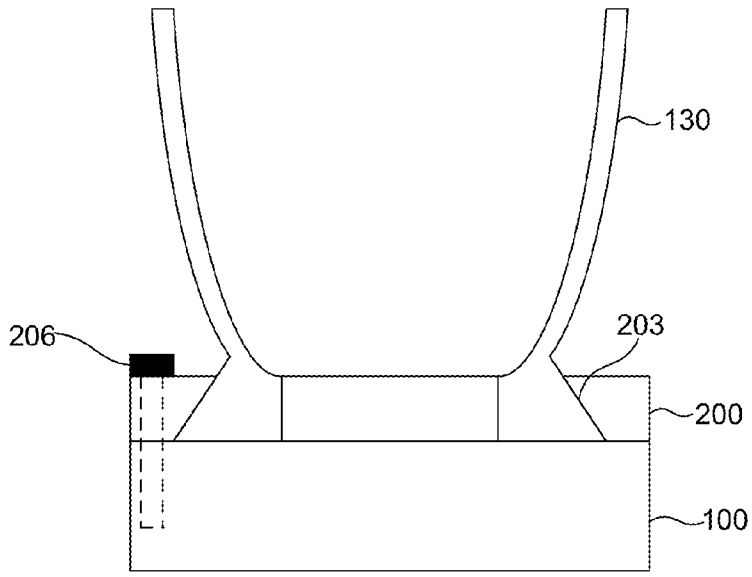
FIG. 20A illustrates a side view of LED based illumination module, a mounting collar assembly, and top facing heat sink.
Figure 20B:
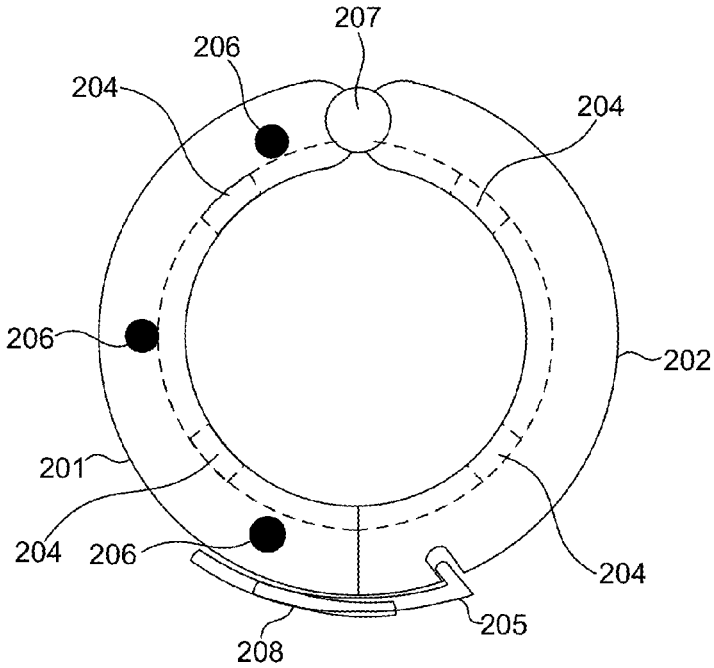
FIG. 20B illustrates a top view of the mounting collar assembly.

FIGS. 20A-20B illustrate yet another embodiment suited for convenient removal and installation of a top facing heat sink 130 from an LED based illumination module 100.

FIG. 20A illustrates a side view of illumination module 100, mounting collar assembly 200, and top facing heat sink 130. Heat sink 130 includes a tapered surface 203 positioned at the perimeter of heat sink 130. As depicted in FIG. 20A, surface 203 tapers toward the center of heat sink 130 from the bottom of the heat sink 130 toward the top. Also, as depicted in FIG. 20A, surface 203 is a continuous surface over the entire perimeter of heat sink 130. In other embodiments, surface 203 may be positioned at several discrete locations at the perimeter of heat sink 130, rather than encompassing the entire perimeter.

FIG. 20B illustrates a top view of mounting collar assembly 200. As depicted in FIG. 20B, mounting collar assembly 200 includes a fixed retaining member 201 and a movable retaining member 202. Fixed retaining member 201 and movable retaining member 202 are coupled by hinge element 207 with an axis of rotation in a direction normal to the output window 108 of module 100. In this arrangement, movable retaining member 202 is operable to rotate about the axis of rotation with respect to fixed retaining member 201. In some embodiments fixed retaining member 201 is coupled to bottom facing heat sink 131 by suitable fastening means. In some other embodiments fixed retaining member 201 is coupled to LED based illumination module 100 by suitable fastening means. For example, fixed retaining member 201 may be coupled to LED based illumination module 100 by screws 206. In other examples, fixed retaining member 201 may be coupled to LED based illumination module 100 by adhesives or by a weld, or any combination of screws, weld, and adhesives. Fixed retaining member 201 and movable retaining member 202 include tapered elements 204. The tapered surface of elements 204 matches the taper of tapered surface 203.

Top facing heat sink 130 is replaceably coupled to illumination module 100 by placing heat sink 130 within fixed retaining member 201 of mounting collar assembly 200. Movable retaining member 202 is rotated with respect to fixed retaining member 201 to capture heat sink 130 within mounting collar assembly 200. As movable retaining member 202 is rotating closed, tapered elements 204 make contact with heat sink 130 and capture heat sink 130 within assembly 200 and LED based illumination module 100. In an aligned position, the bottom surface of heat sink 130 is in contact with LED based illumination module 100 and tapered elements 204 of assembly 200 are in contact with heat sink 130. Buckle 205 of moveable retaining member 202 is coupled to fixed retaining member 201 and moved to a closed position. Buckle 205 includes an elastic element 208. As buckle 205 is moved to the closed position, elastic element 208 deforms and a clamping force is generated that acts in the direction of closure between the fixed and movable retaining elements. The clamping force acting in the direction of closure generates a force to press heat sink 130 against LED based illumination module 100. The interaction between tapered elements 204 and tapered surface 203 of heat sink 130 causes a portion of the clamping force to be redirected to the direction normal to the bottom surface of heat sink 130. In this manner, deforming elastic element 208 as movable retaining member 202 rotates to the fully closed position generates a force acting to press heat sink 130 against LED based illumination module 100.

In the illustrated example, a buckle 205 is employed to couple movable retaining member 202 to fixed retaining member 201. In some embodiments, buckle 205 may be mounted to fixed retaining member 201 rather than member 202. In other embodiments, a screw, clip, or other fixing means may be employed to drive and retain movable retaining member 202 with respect to fixed retaining member 201 in the closed position.

Figure 21:
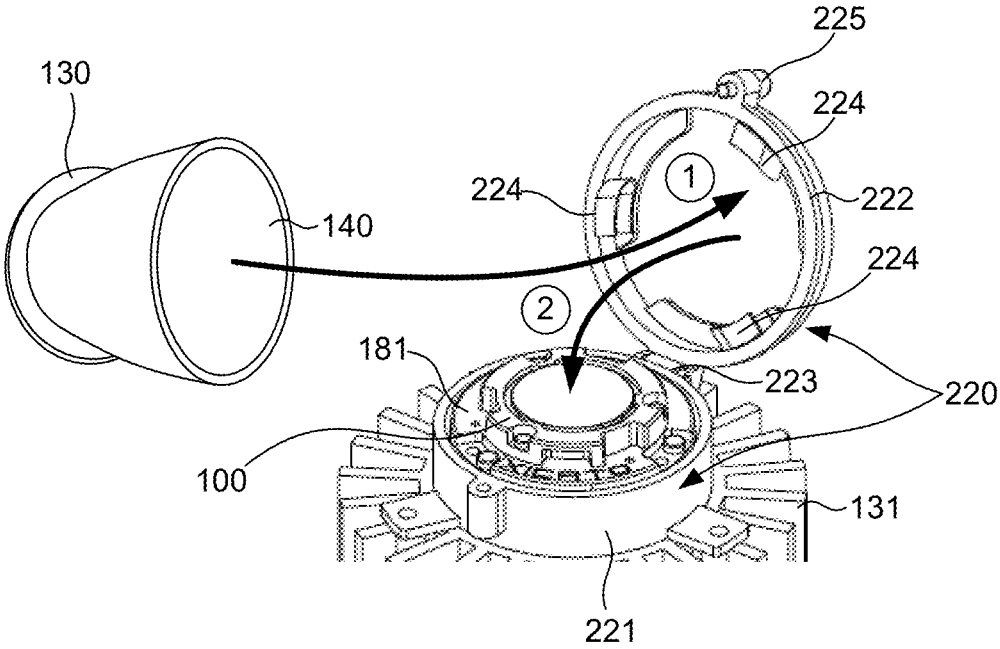
FIG. 21 illustrates a perspective, exploded view of LED based illumination module, a mounting collar assembly, top facing heat sink, and bottom facing heat sink.

FIG. 21 illustrates yet another embodiment suited for convenient removal and installation of a top facing heat sink 130. FIG. 21 illustrates a perspective, exploded view of illumination module 100, mounting collar assembly 220, top facing heat sink 130, and bottom facing heat sink 131 in one embodiment. As depicted, top facing heat sink 130 includes the reflector 140. However, in other embodiments, a separate reflector (not shown) may be included. Mounting collar assembly 220 includes a base member 221 and a retaining member 222. Base member 221 and retaining member 222 are coupled by hinge element 223. In this arrangement, retaining member 222 is operable to rotate about the axis of rotation of hinge 223 and move with respect to base member 221. In the depicted embodiment, base member 221 is coupled to bottom facing heat sink 131 by suitable fastening means. However, in some other embodiments base member 221 is coupled to LED based illumination module 100 by suitable fastening means. In the illustrated example, base member 221 is coupled to bottom facing heat sink 131 by screws. In other examples, base member 221 may be coupled to bottom facing heat sink 131 by adhesives or by a weld, or any combination of screws, weld, or adhesives.

In the illustrated embodiment, illumination module 100 is placed within base member 221. In this manner module 100 is aligned with mounting collar assembly 210. Top facing heat sink 130 may be passed through retaining member 222 as depicted. In other embodiments, top facing heat sink may be passed from the top of retaining member 222 through inlet features. In this manner, top facing heat sink 130 is aligned with retaining member 222.

Together, top facing heat sink 130 and retaining member 222 are rotated with respect to base member 221 to capture top facing heat sink 130 within mounting collar assembly 220. Retaining member 222 includes elastic mounting members 224. As top facing heat sink 130 and retaining member 222 is rotating closed, elastic mounting members 224 make contact with top facing heat sink 130 and generate a compressive force between top facing heat sink 130 and illumination module 100. Elastic mounting members 224 are configured such that contact is made between top facing heat sink 130 and LED based illumination module 100 before retaining member 222 reaches a fully closed position. As a result, after initial contact, elastic mounting members 224 deform until retaining member 222 reaches the fully closed position. In the illustrated example, a threaded screw 225 is employed to couple retaining member 222 to base member 221. In some embodiments, threaded screw 225 includes a knurled surface operable by human hands to drive and retain retaining member 222 with respect to base member 221 in the closed position. In other embodiments, a buckle, clip, or other fixing means may be employed to drive and retain retaining member 222 with respect to base member 221 in the closed position. By deforming elastic mounting members 224 as retaining member 222 rotates to the fully closed position, members 224 generate a force acting to press top facing heat sink 130 against LED based illumination module 100. A thermal interface surface of top facing heat sink 130 contacts, by way of example, thermal interface surface 181 of LED based illumination module 100. A pliable, thermally conductive pad or thermally conductive paste may be employed between the thermal interface surfaces to enhance the thermal conductivity at their interface. In this manner heat generated by LED based illumination module 100 is dissipated to the environment through top facing heat sink 130.

Figure 22:
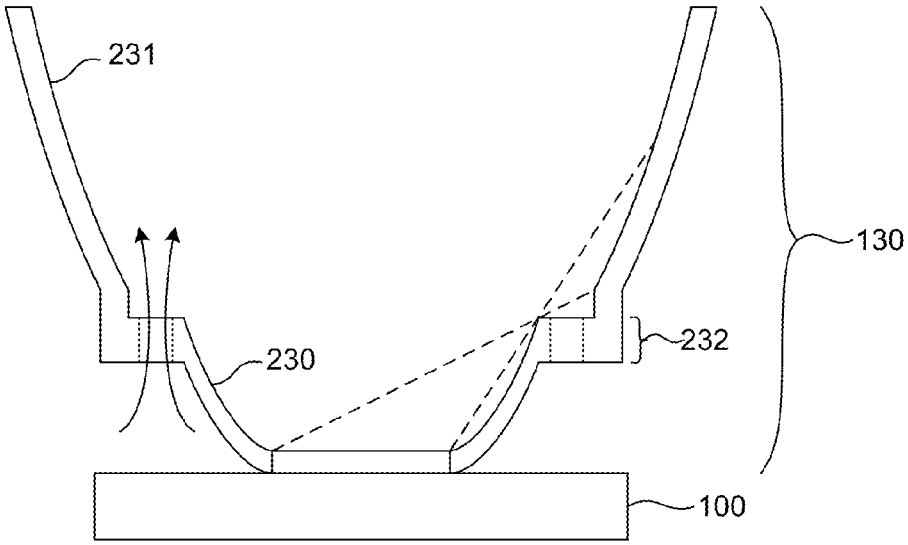
FIGS. 22-23 illustrate a side view and a top view of an embodiment of top facing heat sink with reflective surfaces and a vented portion that includes openings to allow air flow through heat sink.
Figure 23:
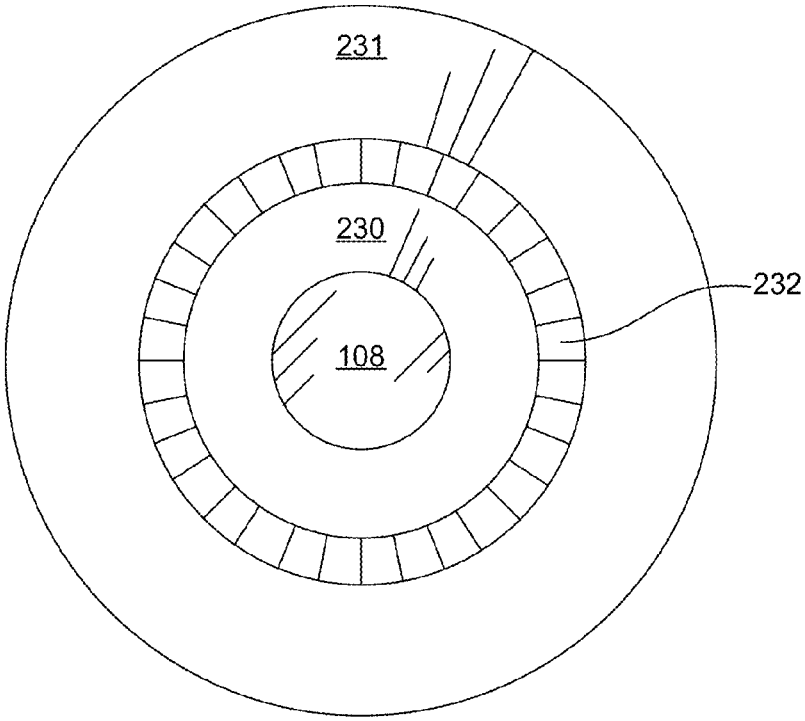

FIGS. 22-23 illustrate a side view and a top view of an embodiment of top facing heat sink 130 suited for enhanced dissipation of heat from LED based illumination module 100 without impacting the optical properties of included reflector surfaces. As discussed herein heat sink 130 is thermally coupled to LED based illumination module 100 to promote the dissipation of heat generated by LED based illumination module 100. As depicted, heat sink 130 includes a reflective surface 230 with a first surface profile and another reflective surface 231 with a second surface profile. Reflective surfaces 230 and 231 are separated by a vented portion 232 of heat sink 130 that includes openings to allow air flow through heat sink 130. The vented portion of heat sink 130 is not in the direct optical path of light emitted from LED based illumination module 100. The surface profiles of reflective surface 230 and reflective surface 231 are selected to promote uniform light output from luminaire 150 in spite of the optical discontinuity in the reflecting surfaces in heat sink 130 introduced by vented portion 232.

In one embodiment, the surface profile of reflective surface 230 is a twenty degree compound parabolic concentrator (CPC) and the surface profile of reflective surface 231 is a forty degree CPC In some embodiments, heat sink 130 (including reflective surfaces 230 and 231 and vented portion 232) is manufactured as one part by a molding process. However, in some other embodiments, the shapes of reflective surfaces 230 and 231 may cause the molding of heat sink 130 to be prohibitively difficult. In such embodiments, it is desirable to construct heat sink 130 by combining multiple parts. For example two molded parts may be joined (e.g., by chemical bonding, friction bonding, welding, etc.).

Although the embodiments discussed above have been depicted as operable to couple round shaped, top facing heat sinks to similarly shaped LED based illumination modules, the embodiments are also applicable to couple polygonal shaped, top facing heat sinks to similarly shaped LED based illumination modules. For example, a linear displacement, rather than a rotational displacement may be employed to engage a top facing heat sink 130 to a LED based illumination module 100.

Figure 24A:
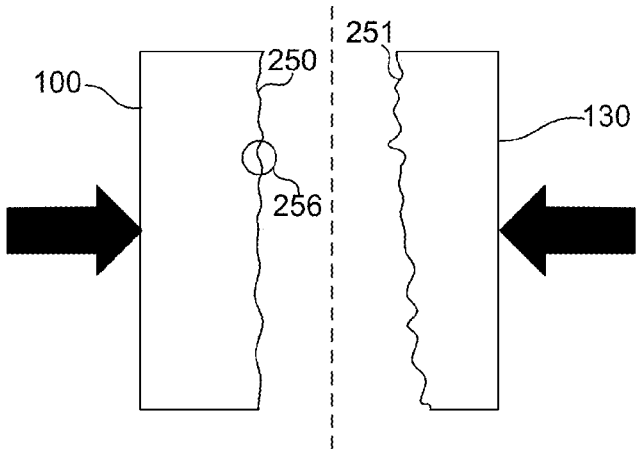
FIG. 24A illustrates a portion of a thermal interface surface of module.
Figure 24B:
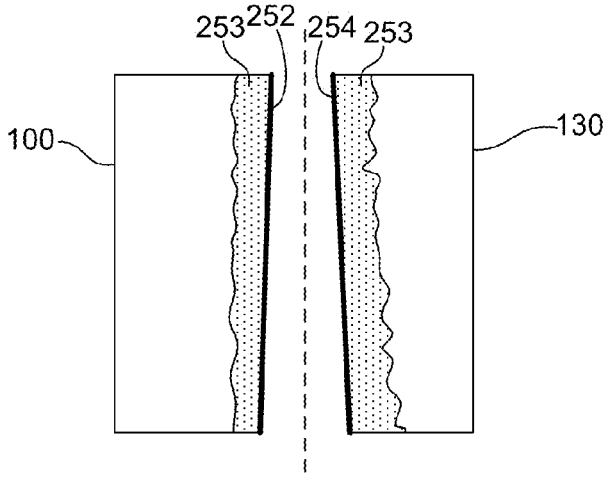
FIG. 24B illustrates thin sheets bonded to thermal interface surfaces.
Figure 24C:
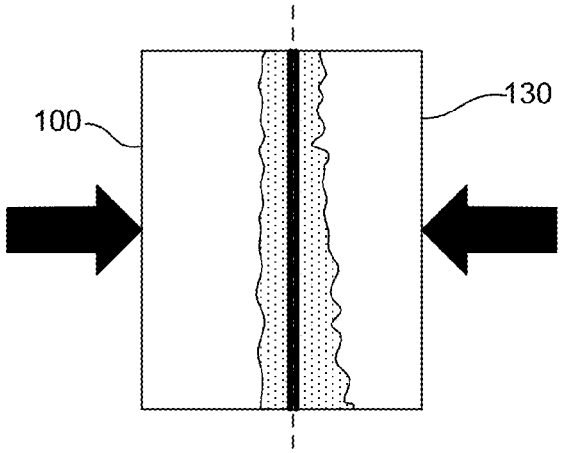
FIG. 24C illustrates thermal interface surfaces in contact with each other through the thin sheets.

Although, the thermal interface surfaces of heat sink 130 and module 100 have been depicted as flat surfaces, non-ideal manufacturing conditions may cause surface variations that negatively impact heat transmission across their interface. FIGS. 24A-24C illustrate thermal interface surfaces configured for improved thermal conductivity in the presence of manufacturing defects present on the interfacing surfaces. FIG. 24A illustrates a portion of a thermal interface surface of module 100 by way of example. The illustrated portion may be a surface of a machined, molded, or cast part, or may be sawn from a larger part. These processes may result in surface imperfections that decrease the heat transmission possible across the surface. In some examples, the imperfections may be local incongruities in the surface as highlighted in portion 256. In other examples, the imperfection may be a surface roughness or dimensional errors that result in a misalignment and limited contact surface area when the two surfaces 250 and 251 are brought together. FIG. 24B illustrates thin sheets 252 and 254 bonded to surfaces 250 and 251, respectively by bonding material 253. Bonding material 253 fills surface incongruities such as those illustrated in portion 256. Sheets 252 and 254 are made by processes such as sheet rolling that assure a high degree of surface flatness. By bonding sheet 252 to surface 250, a rough surface is replaced with a smooth, flat surface. When surfaces 252 and 254 are brought into contact, as illustrated in FIG. 24C, the amount of surface area at their interface is increased compared to the scenario when surfaces 250 and 251 are brought into contact. Surfaces 252 and 254 may also be repeatedly placed into contact and separated without having to clean and reapply conductive grease or pads, thus simplifying module replacement. Bonding material 253 is thermally conductive and acts to transfer heat between sheet surfaces 252 and 254 to surfaces 250 and 251, respectively. In addition, bonding material 253 is compliant. As surfaces 250 and 251 are pressed together, compliant bonding material 253 deforms such that flat surfaces 252 and 254 make full contact across the entire interface despite surface roughness or dimensional errors that would normally limit their contact surface area to an amount less than their entire interface.

Figure 25A:
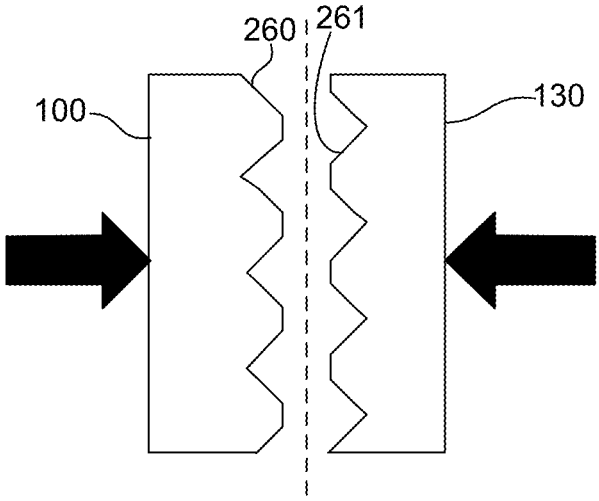
FIG. 25A illustrates a cross-sectional view of a portion of a faceted thermal interface surface.
Figure 25B:
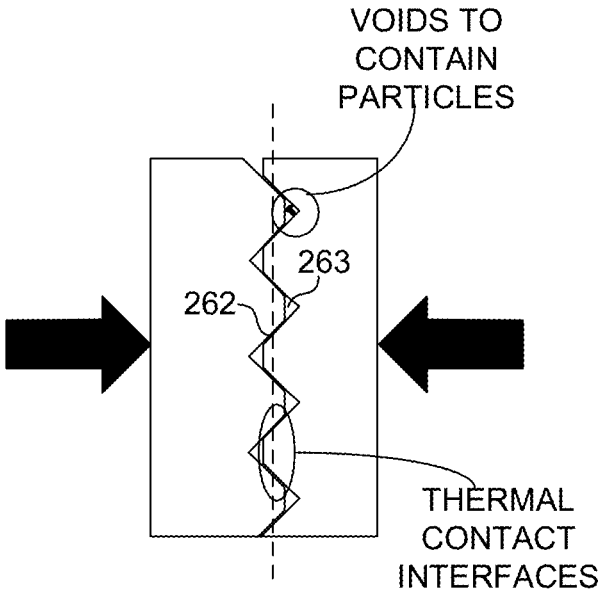
FIG. 25B illustrates faceted thermal interface surfaces in contact.

Although, the thermal interface surfaces of heat sink 130 and module 100 have been depicted as flat surfaces, non-ideal manufacturing conditions may allow surface contaminants to negatively impact heat transmission across their interface. FIGS. 25A-25B illustrate faceted thermal interface surfaces configured for improved thermal conductivity in the presence of contaminant particles. FIG. 25A illustrates a portion of a faceted thermal interface surface 260 of module 100 in a cross-sectional view by way of example. The faceted thermal interface surface 260 may be a machined, molded, or cast part. As illustrated faceted surface 260 has a saw-tooth shape with repeated raised features extending from module 100. Each raised feature is flattened at the tip. Heat sink 130 includes a faceted thermal interface surface 261 with a complementary saw-tooth shaped pattern with repeated raised features extending from heat sink 130. FIG. 25B illustrates module 100 in contact with heat sink 130. As illustrated the repeated pattern of raised portions of interface surfaces 260 and 261 interlock and generate a repeated sequence of thermal contact interfaces 262. In addition, the repeated pattern of raised portions of interface surfaces 260 and 261 interlock and generate a repeated sequence of voids 263. The voids are generated because of the flattened portion at the top of each raised feature of interface surfaces 260 and 261. As surfaces 260 and 261 are brought into contact, surface contaminants become trapped within voids 263 rather than becoming trapped between thermal contact interfaces 262. Contaminant particles trapped between thermal contact interfaces 262 create separation at the thermal interface that impedes heat transmission across the interface. Contaminant particles filling voids 263 do not interfere with heat transmission across the interface. In this manner, faceted surfaces 260 and 261 are shaped to promote improved heat transmission across their interface by providing voids to trap contaminant particles that would otherwise be entrapped between surfaces 260 and 261 and reduce the thermal conductivity at their interface.

In many of the above-described embodiments, the thermal interface surfaces of heat sink 130 and module 100 have been depicted as being placed in direct contact. However, manufacturing defects in the interfacing surfaces of module 100 and heat sink 130 may limit the contact area at their thermal interface. However, in all described embodiments, a pliable, thermally conductive pad or thermally conductive paste may be employed between the two surfaces to enhance thermal conductivity.

In some examples, the amount of deflection, Δ, discussed with respect to the above-mentioned embodiments may be less than 1 millimeter. In other examples, the amount of deflection, Δ, discussed with respect to the above-mentioned embodiments may be less than 0.5 millimeter. In other examples, the amount of deflection, Δ, discussed with respect to the above-mentioned embodiments may be less than 10 millimeters.

Although certain specific embodiments are described above for instructional purposes, the teachings of this patent document have general applicability and are not limited to the specific embodiments described above. For example, module 100 is described as including mounting base 101. However, in some embodiments, base 101 may be excluded. In another example, module 100 is described as including an electrical interface module 120. However, in some embodiments, module 120 may be excluded. In these embodiments, mounting board 104 may be connected to conductors from heat sink 130. Accordingly, various modifications, adaptations, and combinations of various features of the described embodiments can be practiced without departing from the scope of the invention as set forth in the claims.

What is claimed is:

1. An apparatus comprising:

a reflector with a first tapered feature and a first thermal interface surface;

an LED based illumination module with a second thermal interface surface; and a mounting collar including a first member and a second member each with a second tapered feature, wherein the second member is moveable with respect to the first member, and wherein a movement to an engaged position couples the first and second tapered features and generates a compressive force between the reflector and the LED based illumination module coupled to the first member of the mounting collar.

2. The apparatus of claim 1, further comprising:

a hinge element coupled to first and second members of the mounting collar.

3. The apparatus of claim 1, further comprising:

a buckle, wherein the buckle fixedly couples the first member to the second member in the engaged position.

4. The apparatus of claim 1, further comprising a thermally conductive pad disposed between the first and second thermal interface surfaces.

5. The apparatus of claim 1, wherein the first thermal interface surface is a faceted surface with a first surface area, wherein a first portion of the first surface area contacts the second thermal interface surface when the first and second thermal interface surfaces are brought into contact, and wherein a second portion of the first surface area does not contact the second thermal interface surface when the first and second thermal interface surfaces are brought into contact generating a void between the first and second thermal interface surfaces.

6. The apparatus of claim 5, wherein the second thermal interface surface is a faceted surface with a second surface area, wherein a first portion of the second surface area contacts the first thermal interface surface when the first and second thermal interface surfaces are brought into contact, and wherein a second portion of the second surface area does not contact the first thermal interface surface when the first and second thermal interface surfaces are brought into contact generating the void between the first and second thermal interface surfaces.

7. The apparatus of claim 1, wherein the first thermal interface surface is a thin sheet flexibly bonded to the reflector.

8. The apparatus of claim 1, wherein the second thermal interface surface is a thin sheet flexibly bonded to the LED based illumination module.

9. An apparatus comprising:

an LED based illumination module with a first thermal interface surface;

a reflector including a second thermal interface surface; and a mounting collar including a first member and a second member with a plurality of elastic mounting members, wherein the mounting collar is operable to capture the reflector by a movement of the second member relative to the first member, and wherein the movement deforms the elastic mounting members and generates a compressive force between the first and the second thermal interface surfaces.

10. The apparatus of claim 9, further comprising:

a hinge element coupled to first and second members of the mounting collar.

11. The apparatus of claim 9, further comprising:

a buckle, wherein the buckle fixedly couples the first member to the second member in an engaged position.

12. The apparatus of claim 9, further comprising a thermally conductive pad disposed between the first and second thermal interface surfaces.

13. The apparatus of claim 9, wherein the first thermal interface surface is a faceted surface with a first surface area, wherein a first portion of the first surface area contacts the second thermal interface surface when the first and second thermal interface surfaces are brought into contact, and wherein a second portion of the first surface area does not contact the second thermal interface surface when the first and second thermal interface surfaces are brought into contact generating a void between the first and second thermal interface surfaces.

14. The apparatus of claim 13, wherein the second thermal interface surface is a faceted surface with a second surface area, wherein a first portion of the second surface area contacts the first thermal interface surface when the first and second thermal interface surfaces are brought into contact, and wherein a second portion of the second surface area does not contact the first thermal interface surface when the first and second thermal interface surfaces are brought into contact generating the void between the first and second thermal interface surfaces.

15. The apparatus of claim 9, wherein the first thermal interface surface is a thin sheet flexibly bonded to the LED based illumination module.

16. The apparatus of claim 9, wherein the second thermal interface surface is a thin sheet flexibly bonded to the reflector.

* * * * *